US007775646B2

(12) United States Patent
Yamaguchi

(10) Patent No.: US 7,775,646 B2
(45) Date of Patent: Aug. 17, 2010

(54) LIQUID JET RECORDING APPARATUS

(75) Inventor: Yukuo Yamaguchi, Ohta-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 927 days.

(21) Appl. No.: 11/561,772

(22) Filed: Nov. 20, 2006

(65) Prior Publication Data

US 2007/0115321 A1 May 24, 2007

(30) Foreign Application Priority Data

Nov. 24, 2005 (JP) ..... 2005-338515

(51) Int. Cl.
*B41J 2/175* (2006.01)
*B41J 29/13* (2006.01)

(52) U.S. Cl. ..... 347/86; 347/108

(58) Field of Classification Search ..... 347/37, 347/39, 108, 20, 86, 87
See application file for complete search history.

(56) References Cited

U.S. PATENT DOCUMENTS 6,102,533 A 8/2000 Nozawa
6,338,539 B1 1/2002 Kobayashi

FOREIGN PATENT DOCUMENTS

JP H10-202914 8/1998
JP 2004-042498 2/2004

*Primary Examiner*—Shih-Wen Hsieh
(74) *Attorney, Agent, or Firm*—Canon USA Inc IP Div

(57) ABSTRACT

A liquid jet recording apparatus including a recording head configured to record with droplets, a carriage supporting the recording head and configured to scan a recording medium with the recording head in a direction crossing a direction of conveyance of the recording medium, the carriage being movable to a maintenance position, a holder provided in one of the recording head and the carriage, a recording liquid cartridge adapted to contain liquid for recording, the recording liquid cartridge being attachable to and detachable from the holder, and a guiding unit adapted to guide at least two different sides of the recording liquid cartridge, with respect to the carriage that moves to the maintenance position, to the inner wall surface in a vertical direction when the carriage moves and stops the recording liquid cartridge at the maintenance position where the recording liquid cartridge can be attached to or detached from the holder.

3 Claims, 24 Drawing Sheets

LIQUID JET RECORDING APPARATUS

BACKGROUND OF THE INVENTION

1. Field of the Invention

The present invention relates to a liquid jet recording apparatus that forms an image on a recording medium by discharging a recording liquid from a liquid jet recording head. More specifically, the present invention relates to an image input and output apparatus that includes an image reading unit that converts light from an original into an electric signal and a liquid jet recording unit that discharges liquid droplets onto the recording medium so as to record the image.

2. Description of the Related Art

A recording head that employs a recording method which is commonly known as an ink jet recording method, includes a recording liquid storage cartridge. The cartridge can be detachably attached to a holder 103, as shown in FIG. 22. In an example as shown in FIG. 22, seven recording liquid storage cartridges 111, 112, 113, 114, 115, 116, and 117 can be installed into the holder 103. Each of the recording liquid storage cartridges can be independently and separately attached and detached to and from the holder 103. The holder 103 has a box-like shape whose one face is opened. Each of the recording liquid storage cartridges can be inserted through the opened side so as to be installed into the holder 103. Each cartridge has a recording liquid supply port 211 (FIG. 23A) formed on a bottom of the holder 103. The recording liquid supply port 211 is engaged with a joint portion provided in a base of the holder 103.

FIGS. 23A through 23D illustrate steps of mounting the cartridge 111. In the mounting steps, first, as shown in FIG. 23A, the cartridge 111 is inserted into the holder 103. The insertion is performed while a face of the cartridge 111 that includes the recording liquid supply port 211 is directed onto an upper face of the holder 103, and a face including a protrusion 132 is directed downward. Then, the cartridge 111 is inserted along an inclined surface on a right side of the holder 103 as shown in FIG. 23B. Thus, the protrusion 132 is guided to a position corresponding to a second slot 242 of the holder 103 of the cartridge 111. As shown in FIG. 23C, the cartridge 111 is pressed into the holder 103, so that a latch lever 130 is inwardly bent. Then, finally, as shown in FIG. 23D, a hook 131 formed on the latch lever 130 engages into a first slot 241 of the holder 103, and the protrusion 132 engages into the second slot 242. Thus, the cartridge 111 is fixed into the holder 103. When the cartridge 111 is installed to the holder 103, a recording liquid contained in an absorption member 136 is guided into the recording head via a joint 137 disposed in the recording liquid supply port 211.

In detaching the cartridge 111, the latch lever 130 is inwardly bent again to disengage the hook 131 out of the first slot 241 of the holder 103. Thus, the cartridge 111 can be readily detached from the holder 103.

In the above configuration, the cartridge can be readily attached and detached to and from the holder 103 from a top of the recording head. A recording apparatus that includes a head has a maintenance cover for opening an upper portion of the apparatus or upper and front portions of the apparatus in order to perform an operation for attaching and detaching the cartridge. Japanese Laid-Open Patent Application No. 2004-042498 discusses the recording apparatus of this type.

The head can be integrally formed to the holder 103 that is mounted on the apparatus, as discussed in U.S. Pat. No. 6,102,533. However, the head can also be detachably attached to the apparatus itself. The configuration in which the cartridge can be individually replaced, has an advantage in that a running cost of the apparatus is relatively low. However, a liquid storage unit can also be integrally mounted on a recording head, and the recording head can be detachably attached to the apparatus. Also in these cases, a configuration is known in which the operation for detachably attaching the head can be performed from the top of the apparatus.

When the operation for detachably attaching the head is repeatedly performed, a possibility is high that a discharge port forming surface is damaged by a collision with other portions of the apparatus. Accordingly, the operation for detachably attaching the head is desirably performed with an access from the top of the apparatus. In this configuration, the operation can be performed while relatively easily avoiding the damage of the discharge ports forming surface.

There is a printer that is equipped with an image input and output function, which is called a multi-function printer (MFP). In the MFP apparatus, an image recording mechanism (i.e., a liquid jet recording unit) is disposed in a lower stage of the apparatus, and an image reading mechanism is disposed in an upper stage of the apparatus as a scanner unit.

In the MFP, in order to replace the cartridge and the head from the top of the apparatus as described above, the scanner unit needs to be retracted. In order to perform retraction, the scanner unit is swung upward so as to open the scanner unit into a crocodile mouth shape, or the scanner unit can be moved in a sliding manner. The latter configuration has a disadvantage such that an amount of extrusion of the scanner unit from the apparatus due to the sliding retraction is large and that an extra space needs to be secured in installing the apparatus. Accordingly, the apparatus has a complicated structure and the cost for manufacturing becomes high. On the other hand, the former configuration has an advantage such that the amount of extrusion of the scanner unit from the apparatus at the time of retraction (i.e., swing movement) can be reduced and that the apparatus can be manufactured at a lower cost with a simple configuration.

With respect to the scanner unit of the MFP, a flat bed type scanner is commonly used in which a transparent platen onto which the original is placed, is provided in an upper portion of a scanner housing. The image reading unit that can move in parallel to the platen, is provided inside the housing. In the flat bed type scanner unit, a recording medium having a specific dimension such as a recording paper can be horizontally placed on the platen, and accordingly, a depth of the scanner unit becomes large. On the other hand, with respect to the recording unit of the MFP, a recording position at which the liquid droplet is discharged, namely, the position where the head is disposed, is set in a back of the apparatus. In this configuration, the recording medium with a recorded image is ejected to the front of the apparatus by a reduced amount.

When the cartridge or the head is replaced, especially in the case where the scanner unit is swung upward from the front so as to be retracted, a user or a operator needs to perform the replacement by inserting his fingers deep into the inside of the apparatus from the front of the apparatus. Accordingly, especially when the operation is performed under an common illumination of an ordinary room, the illuminating light incident into the portion of operation is cut off by the scanner unit positioned above the operator. Thus, the operator has to perform the replacement operation in the dark around a hand. Accordingly, the operability is not necessarily good. That is, there is a concern that the cartridge and the head collide with the housing of the apparatus during the replacement operation, resulting in damaging the head, cartridge, and an inner component of the apparatus.

In order to improve the operability, a retraction angle (opening angle) of the scanner unit can be set large (e.g., the scanner unit can be swung at an angle of 90 degrees). However, when the swing angle of the scanner unit is large, an acceleration at a time of closing the scanner unit becomes high and accordingly, the scanner unit is likely to be swung with too much force. Therefore, it is necessary that a safety measure for suppressing the swing of the scanner unit moving with too much force is sufficiently taken in designing the apparatus, which increases the cost of manufacturing.

Not only in the MFP as described above, but in an ordinary recording apparatus called a single-function printer (SFP), there is also a disadvantage when the upper portion of the apparatus needs to be opened for replacement of the cartridge and the head. There is an SFP in which an upper face of an external cover serving as a ceiling is horizontal. The horizontal face has an advantage such that a convenience of the user is improved because a recording paper before printing and other materials can be placed on the horizontal face. However, the SFP has a disadvantage such that the materials placed on the apparatus needs to be temporarily removed every time the upper portion of the apparatus is opened for the replacement of the cartridge, resulting in extremely degrading the operability.

SUMMARY OF THE INVENTION

The present invention is directed to a liquid jet recording apparatus with improved operability, convenience, and simplicity in replacing a cartridge.

According to an aspect of the present invention, a liquid jet recording apparatus includes an upper face and an inner wall surface opposing the upper face, a recording head configured to record with droplets, a carriage supporting the recording head and configured to scan a recording medium with the recording head in a direction crossing a direction of conveyance of the recording medium, the carriage being movable to a maintenance position, a holder provided in one of the recording head and the carriage, a recording liquid cartridge adapted to contain liquid for recording, the recording liquid cartridge being attachable to and detachable from the holder, and a guiding unit adapted to guide at least two different sides of the recording liquid cartridge, with respect to the carriage that moves to the maintenance position, to the inner wall surface in a vertical direction when the carriage moves and stops the recording liquid cartridge at the maintenance position where the recording liquid cartridge can be attached to and detached from the holder.

According to another aspect of the present invention, a liquid jet recording apparatus includes a recording head configured to record with droplets, a carriage supporting the recording head and configured to scan a recording medium with the recording head in a direction crossing a direction of conveyance of a recording medium, the carriage including a holder, the carriage being movable to a maintenance position where the recording liquid cartridge can be attached and detached to and from the holder, a recording liquid cartridge adapted to contain liquid for recording, and a guiding unit adapted to guide at least two different sides of the carriage, with respect to the holder of the carriage that stops at the maintenance position, to an inner wall surface of the recording head or a cartridge fixing member opposing an upper face of the holder in a vertical direction when the carriage moves and stops the recording liquid cartridge at the maintenance position.

According to the present invention, a recording liquid storage cartridge can be readily and appropriately attached and detached by an access from the front of the apparatus. Accordingly, the operability in replacing the recording liquid storage cartridge can be improved, and the convenience and simplicity of the configuration which enables the replacement of the cartridge, can also be improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Exemplary embodiments of the present invention will now be described in detail with reference to the drawings. It should be noted that the relative arrangement of the components, the numerical expressions, and numerical values set forth in these embodiments do not limit the scope of the present invention unless it is specifically stated otherwise.

First Embodiment

Figure 1:
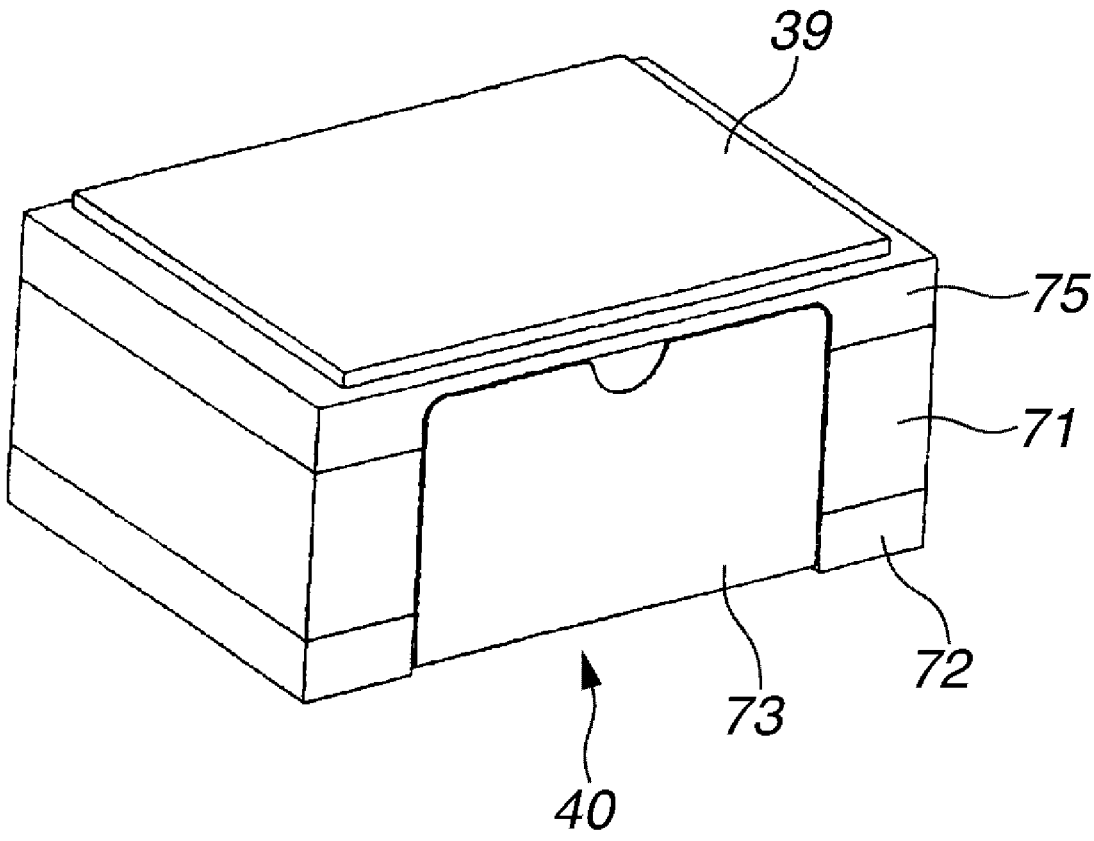
FIG. 1 is a perspective view that illustrates an MFP according to a first embodiment of the present invention in which an access cover is closed.
Figure 2:
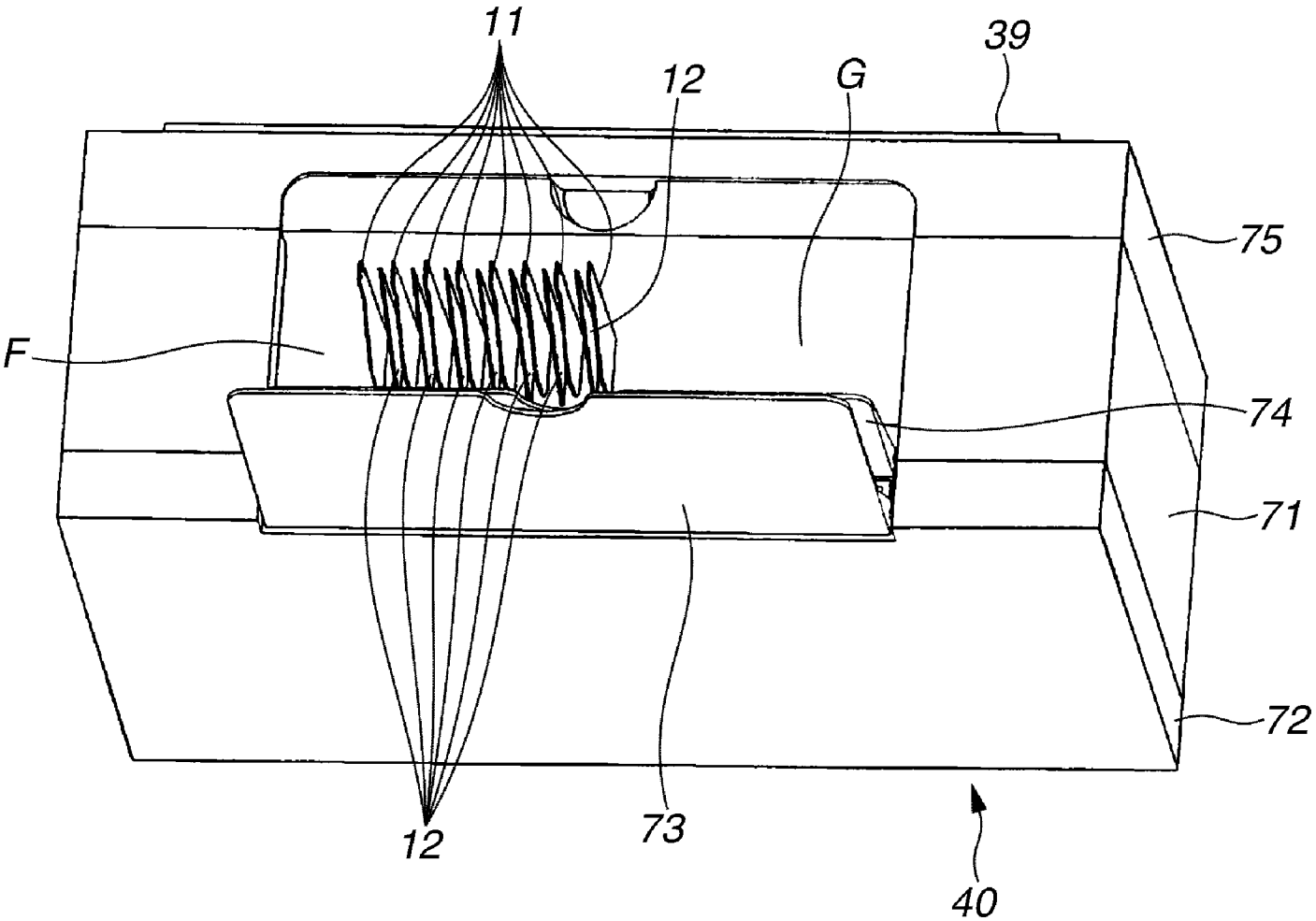
FIG. 2 is a perspective view that illustrates an MFP according to the first embodiment of the present invention in which an access cover is opened.

FIG. 1 and FIG. 2 are perspective views of an MFP 40 such as a liquid jet recording apparatus according to this embodiment. The MFP 40 has a housing that includes a bottom cover 72 that covers a bottom face of the apparatus, a main cover 71, and a scanner housing 75, stacked in order starting from the bottom. At a position corresponding to the main cover 71, a liquid jet recording unit A (see FIG. 3 and other concerned drawing) as described below is disposed. At a position corresponding to the scanner housing 75, a scanner unit B (see FIG. 4 and FIG. 5) as described below is disposed.

On an upper face of the housing, a transparent platen (not shown) of the scanner unit B is disposed. A platen cover 39 is mounted so as to swing open and close, covering the transparent platen of the scanner unit B. On a front face of the housing, a paper discharge cover 73 is mounted. The paper discharge cover 73 is mounted so as to swing between a position along the housing of the apparatus as a part of an outer surface of the apparatus housing, and a position at which the paper discharge cover 73 is horizontally placed as shown in FIG. 2. Thus, the paper discharge cover 73 swings around its lower edge. A recording medium having an image recorded by the liquid jet recording unit A is placed onto the paper discharge cover 73 which is horizontally positioned. In an inner portion of the paper discharge cover 73, an access cover 74 that can be swung opened and closed around the lower edge of the paper discharge cover 73, is arranged.

Figure 3:
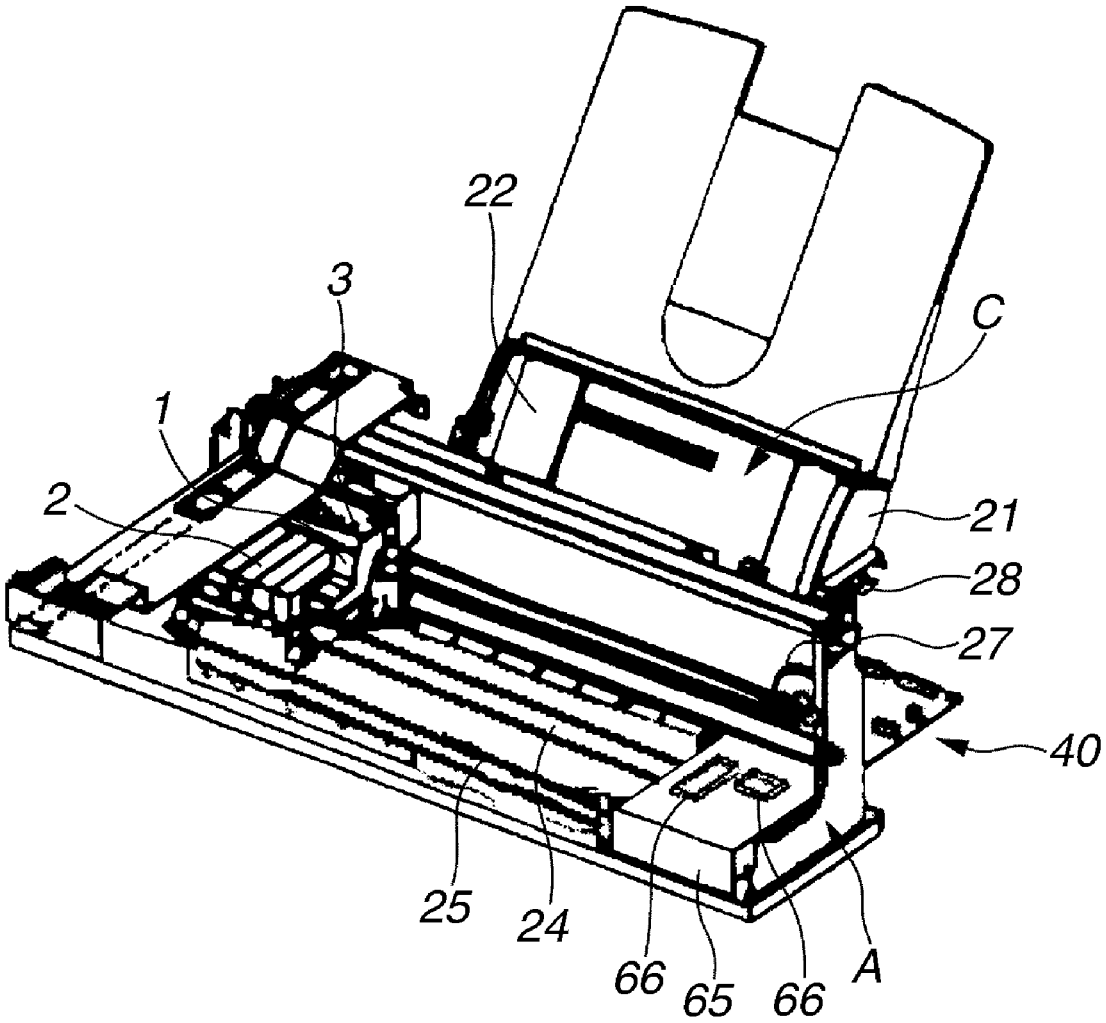
FIG. 3 is a front perspective view that illustrates the MFP according to the first embodiment of the present invention, in which a housing and an image reading unit is removed, seen in a slanting direction.
Figure 4:
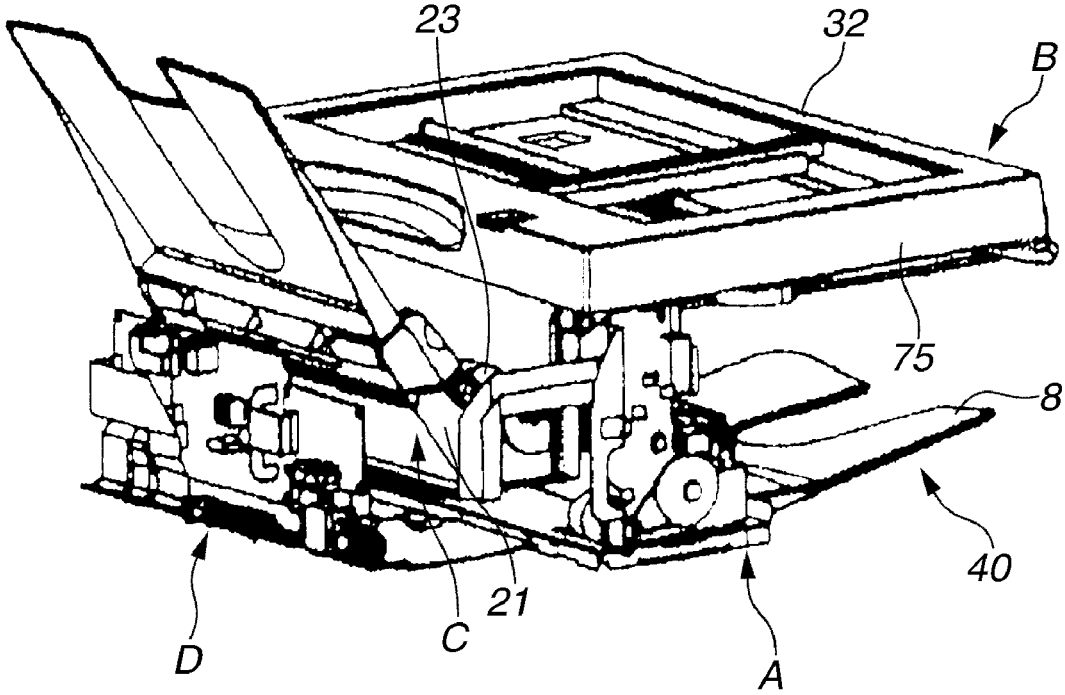
FIG. 4 is a rear perspective view that illustrates the MFP according to the first embodiment of the present invention in which the housing is removed, seen in a slanting direction.
Figure 5:
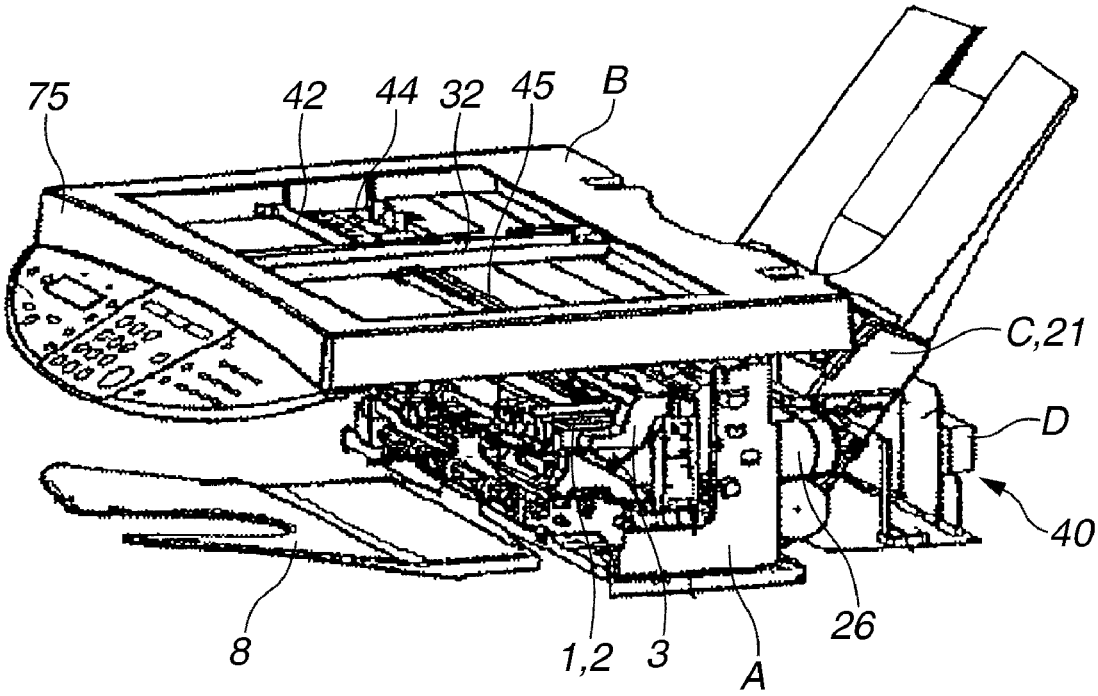
FIG. 5 is a front perspective view that illustrates the MFP according to the first embodiment of the present invention in which the housing is removed, seen in a slanting direction.

FIGS. 3 through 5 are perspective views that respectively illustrate an inner configuration of the MFP 40, in which the apparatus housing is removed. FIG. 3 is a perspective view that illustrates only the liquid jet recording unit A as the inner configuration. FIG. 4 and FIG. 5 are perspective views that respectively illustrate an entire apparatus seen from the back and the front side.

The MFP 40 includes the liquid jet recording unit A and the scanner unit B. In addition, the MFP 40 includes a paper feed unit C that separates the recording medium from stacked recording media and supplies the separated recording medium to the recording unit A. The MFP also includes an electrical device unit D including a power supply and a control unit. In this embodiment, the scanner unit B is fixed above the recording unit A. The MFP 40 can be connected to other devices such as a computer and a receiver transmitter, as necessary. With these functional units installed, the MFP 40 can function as a printer, a copying machine, and a facsimile.

Figure 6:
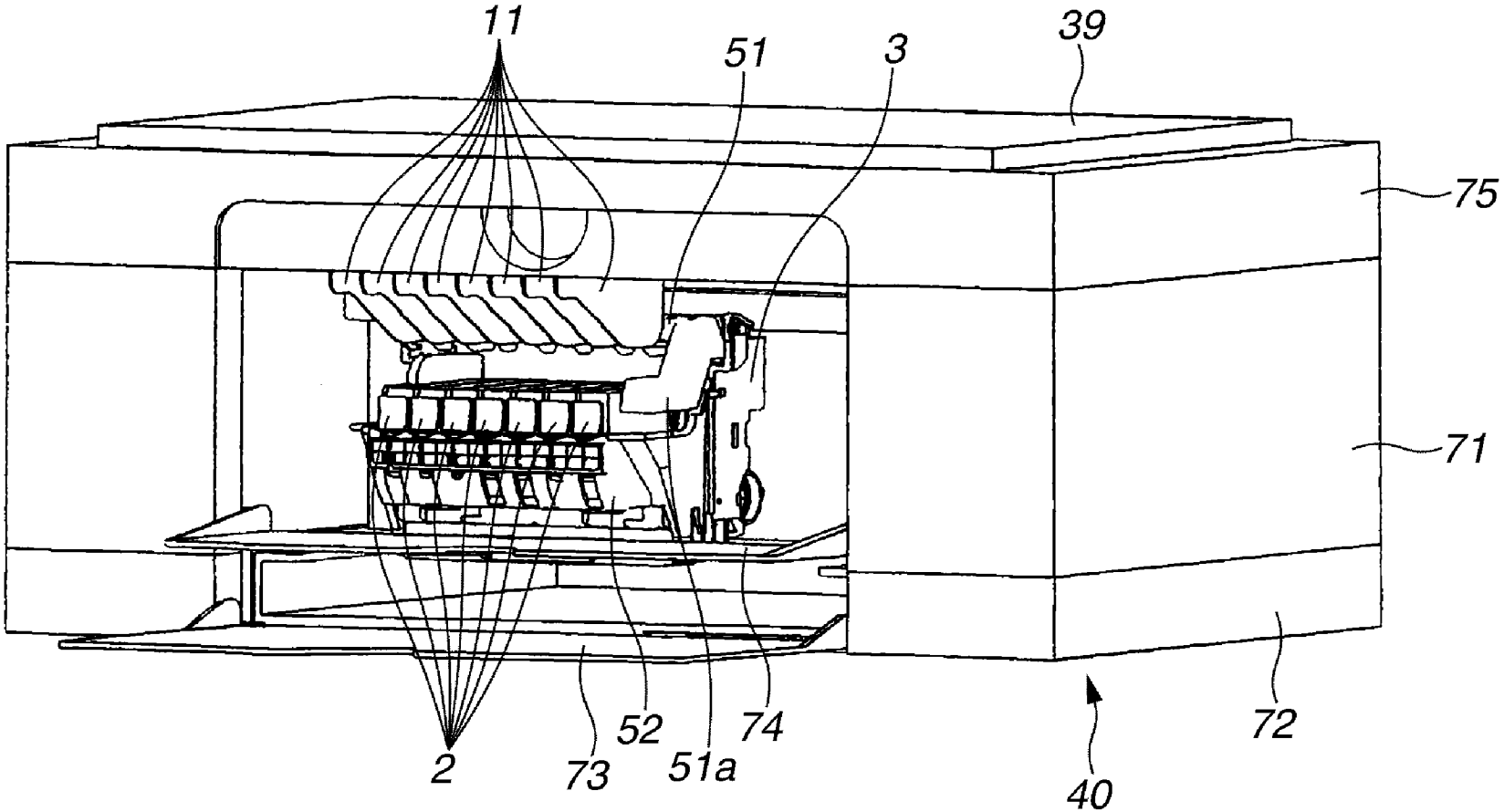
FIG. 6 is a perspective view that illustrates the MFP according to the first embodiment of the present invention in which a carriage mounting all recording liquid storing cartridges comes to a stop in a cartridge replacement area.

In this embodiment, a carriage 3 includes a carriage cover (holder) 52, which has a box-like shape and is opened upward (see FIG. 6 and other relevant drawings). In an inner portion of the carriage cover 52, a recording head 1 and a plurality of cartridges 2 can be detachably attached. Each of the cartridges 2 can be replaced with a new cartridge when recording liquid stored therein is completely consumed. The recording head 1 is rarely replaced with a new head after being mounted on the carriage 3. However, the recording head 1 can be replaced with a new head when a defective condition appears in the recording head 1 or when the recording head 1 becomes too aged. In order to install each of the plural cartridges 2 having a thin rectangular solid shape, the recording head 1 and the carriage cover 52 includes partitioning members 1*b* and 52*c* (see FIG. 8A and other drawings) that are disposed between installation portions of the cartridges 2.

The carriage 3 is connected to an electric circuit of the electrical device unit D via a flexible cable (not shown) in order to send a recording command signal and to supply power to the recording head 1. The recording head 1 is connected by pressure contact to a contact point where the recording head 1 is connected to the flexible cable. The recording head 1 is installed and fixed at a given position as described below.

When a record waiting mode is selected or when a power switch of the apparatus is turned off, the recording head 1 is conveyed above a discharge recovery unit 65 by the carriage 3. A cap 66 of the discharge recovery unit 65 comes in pressure contact with a discharge port forming surface of the liquid jet recording head 1 and assumes a capping state where the discharge port forming surface is sealed off. Thus, thickening of a recording liquid solvent due to evaporation and entering of dust into an inner portion of a discharge port can be prevented, so that a poor discharge condition of the recording liquid can be suppressed.

The electrical device unit D includes a control board of the liquid jet recording unit A, a control board of the scanner unit B, a system control board for controlling the entire image input and output apparatus, an operation control board, and a power supply board.

In a recording operation performed by the MFP 40 according to the present invention, first, the recording medium stacked on a paper feed tray 21 is fed by a paper feed roller 23 while a side of the recording medium is guided by a slider 22. Next, the recording medium is nipped and conveyed by a conveyance roller 24 and a wheel. When the recording medium enters into an inner portion of the recording unit A, the carriage 3 performs reciprocating motion. Then, liquid droplets are discharged by the recording head 1 so as to record the image of a given width equal to a width of a discharge port array of the recording head 1. The conveyance of the recording medium and the image recording operation are repeated to record the image over the entire recording medium. When the recording of the image on the recording medium is completed, the recording medium is pinched and conveyed by a paper discharge roller 25 and a spur to be discharged onto a paper discharge tray 8. The recording medium discharged onto the paper discharge tray 8 can be taken out from a front side of the apparatus that is opened by the paper discharge cover 73.

In the MFP 40 according to this embodiment, the access cover 74 is opened when the recording head 1 or the cartridge 2 is replaced. The access cover 74 is also opened in order to resolve a jamming of the recording medium in a conveyance unit. As shown in FIG. 2, when the access cover 74 is opened, the front portion of the housing is opened so as to allow an access to the liquid jet recording unit A disposed inside the housing. An area (maintenance positions) opened by the access cover 74 is set for a cartridge replacement (first maintenance position) F which has a width equal to the width of the carriage, and a head replacement (second maintenance position) G.

When the access cover 74 is opened, the recording apparatus recognizes that a cartridge replacement mode is selected. The replacement mode can also be selected in accordance with an input made by pressing a switch and an operation of a printer driver. The replacement of the recording head 1 and the cartridge 2 starts when the carriage 3 is in a standby mode in which the carriage 3 stays above the recovery unit 65. However, control can be performed so as to shift the mode to the replacement mode at the time of opening the access cover 74 even when the carriage is in a scanning state or in a scanning standby mode. The selection of the replacement mode can be automatically selected by the operation of opening and closing the access cover 74 as described above. However, the selection of the replacement mode can also be selected in accordance with an input made by pressing a switch and an operation of a printer driver.

Next, the description is made as to a cartridge replacement mode.

When the cartridge replacement mode is selected, the carriage 3 is moved to the cartridge replacement area F, as shown in FIG. 6. At this time, in a normal state where the recording head 1 is in a capping state while the access cover 74 is opened, the cap 66 of the discharge recovery unit 65 is separated from the recording head 1 before the carriage 3 is moved.

In the cartridge replacement area F, a plurality of partitioning boards (partition unit) 11 and guiding boards (guiding unit) 12 (see FIG. 2) are disposed. The partitioning boards 11 and guiding boards 12 are formed extruding from a lower face 75*a* (see FIG. 8A) of the scanner housing 75. When the cartridge 2 is mounted at a given position, lower edges of the partitioning board 11 and the guiding board 12 are positioned at a given distance from an upper edge of the cartridge 2, as shown in FIG. 6. Accordingly, the liquid storage cartridge 2 does not contact with the partitioning boards 11 and the guiding boards 12 when the carriage 3 is reciprocating.

The partitioning board 11 is disposed so that in the cartridge replacement mode, when the carriage 3 stops at a given position, the carriage 3 comes to a position opposing the partitioning members 1*b* and 52*c* of the recording head 1 and the carriage 3. The guiding boards 12 are interposed between the partitioning boards 11. The guiding board 12 serves to guide the cartridge 2 while laying down a given trail when the cartridge 2 is attached and detached to and from the recording head 1 and the carriage 3.

Figure 7:
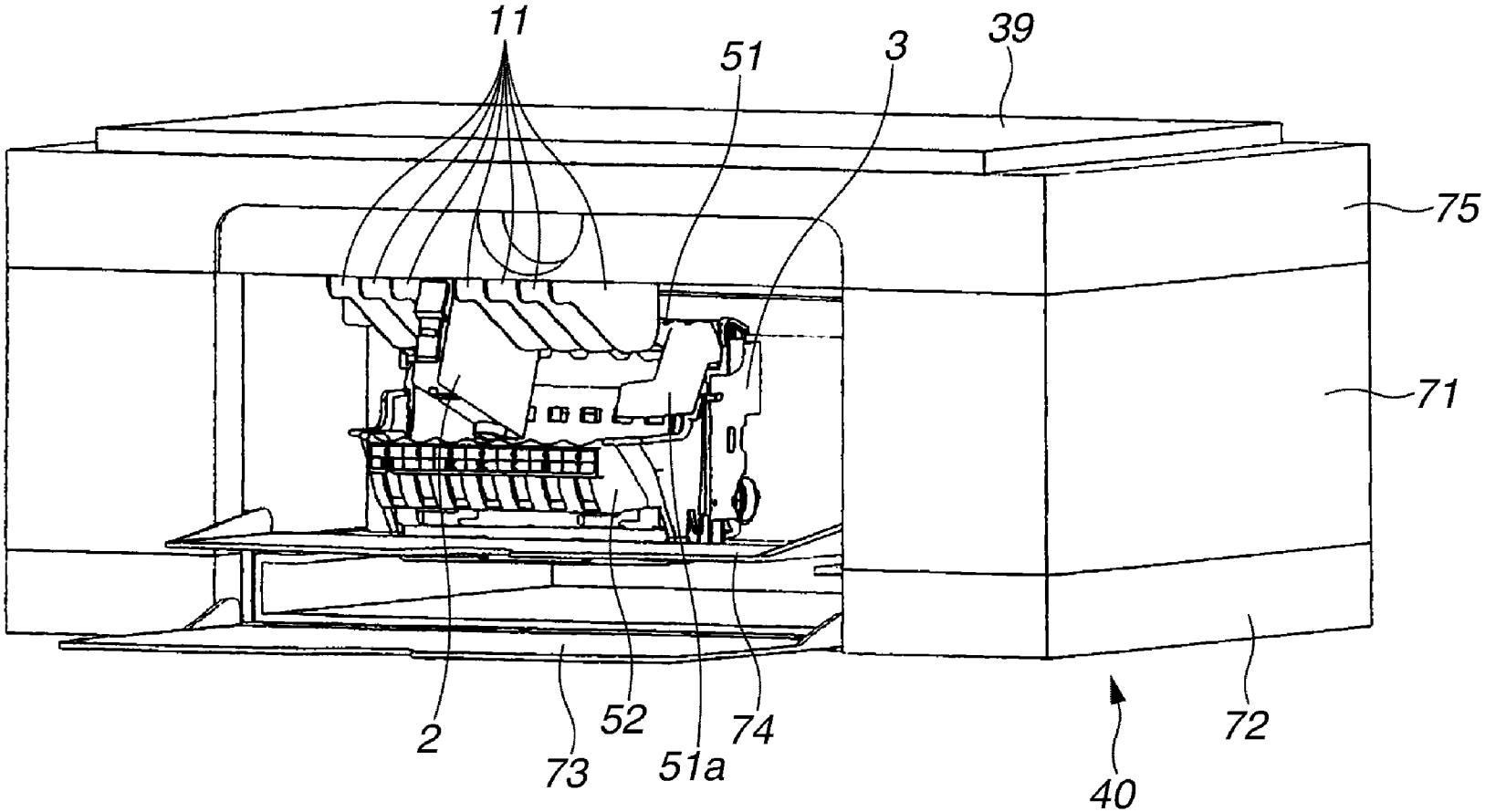
FIG. 7 is a perspective view that illustrates a state where a carriage is mounted with the cartridges that comes to a stop in the cartridge replacement area according to the first embodiment of the present invention.

By using the partitioning board 11 and the guiding board 12, the cartridge 2 can be readily attached and detached to and from a front side of the apparatus. FIG. 7, FIG. 8 A, FIG. 8B, FIG. 8C, and FIG. 8D respectively illustrate a method of mounting the cartridge 2.

Figure 8A:
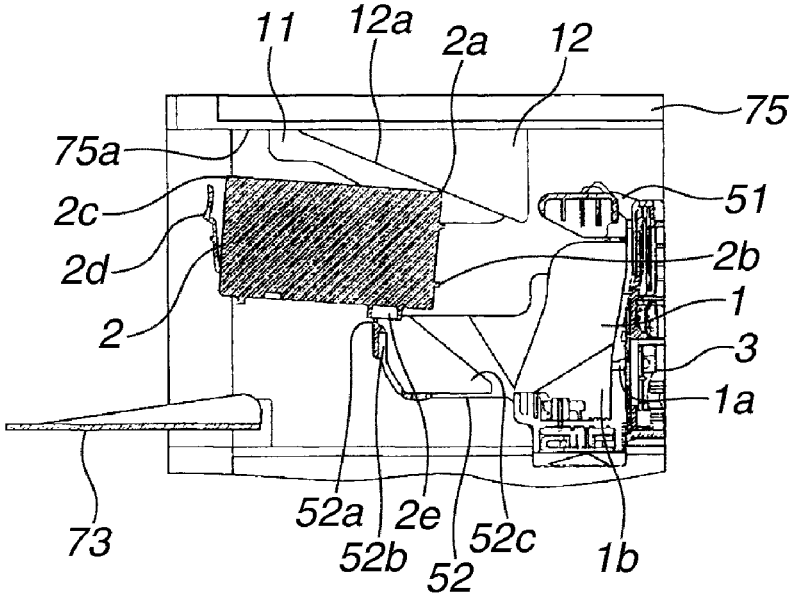
FIG. 8A is a diagram that illustrates a state where the insertion of the cartridges into the recording apparatus is started according to the first embodiment of the present invention.

The cartridge 2 has a joint portion 2*e* for supplying the stored recording liquid to the recording head 1, on its bottom, as shown in FIG. 8A. In order to enable mounting and fixing the cartridge 2 at the given position, a protrusion 2*b* is formed on a front side when the cartridge 2 is inserted for mounting. On a back side, a latch lever 2*d* that can be elastically deformed is mounted. The recording head 1 has a positioning slot 1*a* that is formed at a position corresponding to the protrusion 2*b* of the cartridge 2.

Figure 8B:
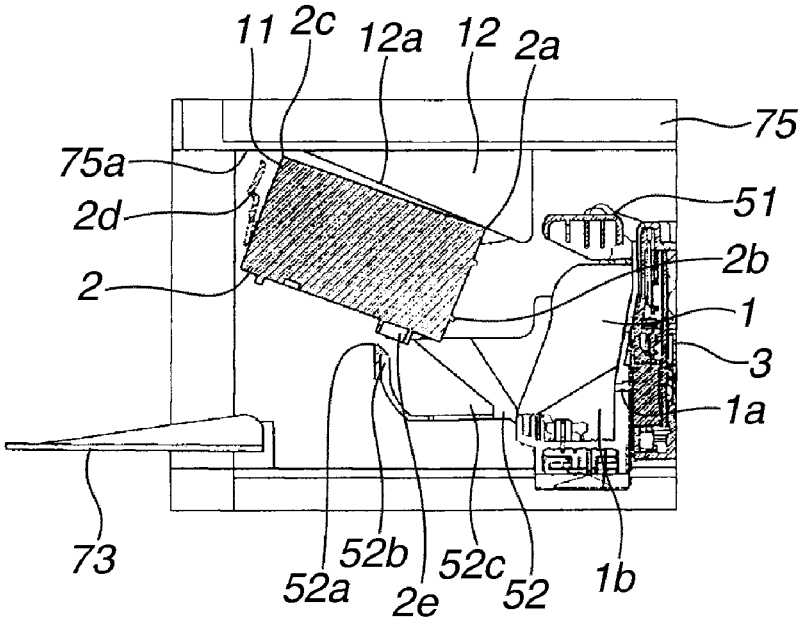
FIG. 8B is a diagram that illustrates a state where the cartridges go along guiding boards according to the first embodiment of the present invention.

When the cartridge 2 is mounted, first, the cartridge 2 is inserted from the front of the apparatus between the lower face 75*a* of the scanner housing 75 and an edge 52*a* of the carriage cover 52, with the joint portion 2*e* in a face-down state. At this time, the cartridge 2 is inserted between the specific partitioning boards 11 corresponding to the mounting position. A leading end 2*a* of a top surface of the cartridge 2 abuts onto an inclined face 12*a* at a lower edge of the guiding board 12. The cartridge 2 is inclined so that the surface having the protrusion 3*b* faces down, as shown in FIG. 7 and FIG. 8B. Then, the leading end 2*a* of the top face of the cartridge 2 is inserted along the inclined face 12*a* of the guiding board 12, sliding on the inclined face 12*a*. Thus, the cartridge 2 is inserted into the carriage cover 52. As the cartridge 2 is inserted in this manner, the protrusion 2*b* of the cartridge 2 is guided to the position corresponding to the positioning slot 1*a* of the recording head 1.

Figure 8C:
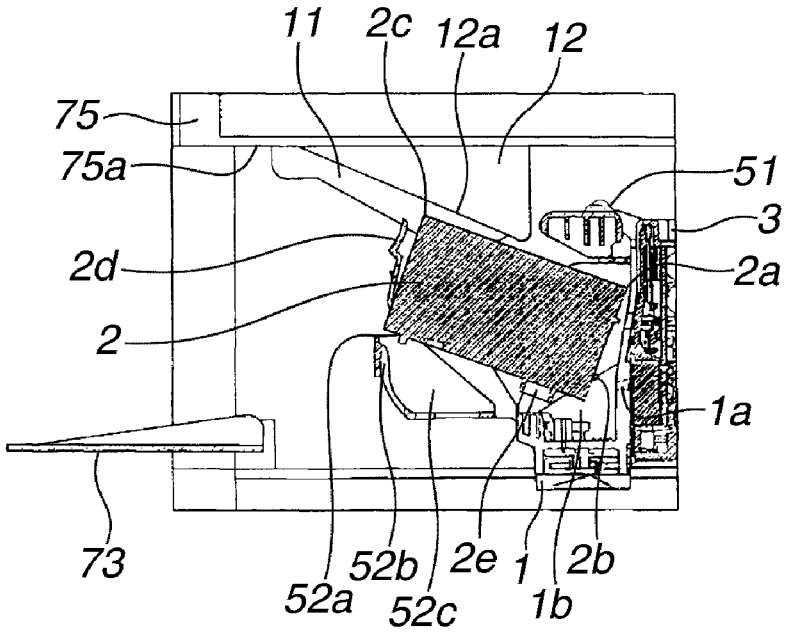
FIG. 8C is a diagram that illustrates a state where the cartridges are inserted in an inclined state according to the first embodiment of the present invention.
Figure 8D:
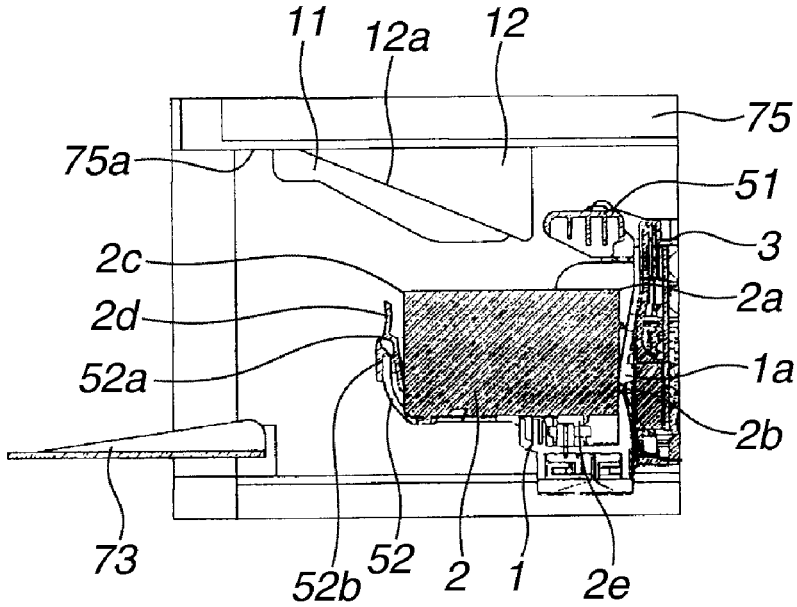
FIG. 8D is a diagram that illustrates the fixation of the cartridge in the recording apparatus according to the first embodiment of the present invention.
Figure 9:
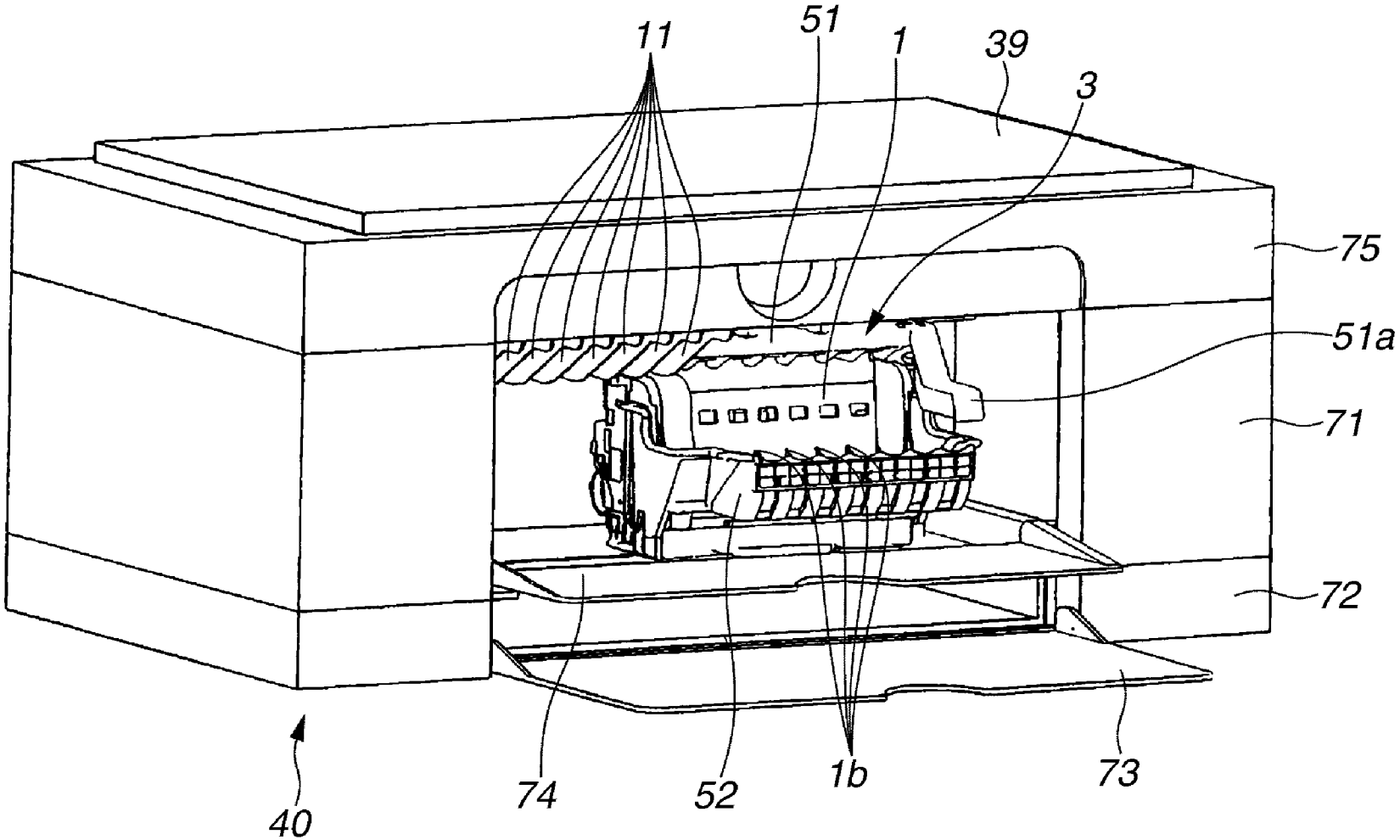
FIG. 9 is a perspective view that illustrates a state where the carriage comes to a stop in a head replacement area according to the first embodiment of the present invention.

After almost completely inserting the cartridge 2 in an inclined state as shown in FIG. 8C, a trailing end 2*c* of the top face of the cartridge 2 is pressed in downwardly. Then, the protrusion 2*b* of the cartridge 2 engages into the positioning slot 1*a* of the recording head 1. The latch lever 2*d* is inwardly bent and interfered by an inner wall face of the carriage cover 52 so as to engage with an engaging portion 52*b* of the carriage cover 52 (see FIG. 8D). The cartridge 2 is completely fixed to the carriage cover 52. A joint portion 2*e* of the cartridge 2 engages securely and appropriately with a recording liquid introducing portion of the recording head 1. Thus, the recording liquid stored in the cartridge 2 can be supplied into the recording head 1 via the joint portion 2*e*.

In detaching the cartridge 2, the latch lever 2*d* is inwardly bent to disengage a hook of the latch lever 2*d* from the engaging portion 52*b* of the carriage cover 52, and then the cartridge 2 is lifted while drawing out the cartridge 2 to the front of the apparatus. At this time, a top face of the cartridge 2 contacts with the inclined face 12*a* of the guiding board 12. The cartridge 2 is taken out sliding on the inclined face 21*a*, while the leading end 2*a* of the top face is inclined downward. The cartridge 2 is guided to follow the insertion trail in a reverse direction, and thus the cartridge 2 can be readily taken out without colliding with the carriage cover 52 or other components.

When the replacement operation of the cartridge 2 is completed and the access cover 74 is closed, the carriage 3 is moved to a position above a discharge recovery unit 45, so as to cap the recording head 1. If the access cover 74 is closed in a state where the cartridge 2 is not set at the given position, the cartridge 2 can collide with the partitioning board 11 when the carriage 3 is moved after the access cover 74 is closed. Accordingly, at a stage of starting the movement of the carriage 3 after the cartridge replacement mode ends, the carriage 3 is desirably moved at a speed lower than a carriage speed in recording. With this configuration, even when the cartridge 2 and the partitioning board 11 interfere with each other, a load on the cartridge 2 and the partitioning board 11 can be reduced. Accordingly, a possibility that the cartridge 2 and the partitioning board 11 suffer a damage, is reduced.

The distance traveled by the carriage 3 is measured by a count type moving distance measurement unit (not shown) such as a linear encoder and a rotational encoder. When the interference between the cartridge 2 and the partitioning board 11 occurs, the load of moving on the carriage 3 increases, and accordingly, a counting speed is lowered or the counting up is not performed. By utilizing the count type moving distance measurement unit, the occurrence of interference between the cartridge 2 and the partitioning board 11 can be immediately detected. When it is determined that the interference between the cartridge 2 and the partitioning board 11 occurs, the movement of the carriage 3 is immediately suspended. By performing the control like this, the damage to the cartridge 2 or the partitioning board 11 due to the interference between the cartridge 2 and the partitioning board 11 can be prevented. Further, by setting the moving speed to be low at the start of movement of the carriage 3, the movement of the carriage 3 can be suspended before the load due to the interference becomes too high. Thus, the damage to the cartridge 2 or the partitioning board 11 can be effectively suppressed.

In addition, a cartridge detection unit that electrically detects a secured engagement of the cartridge 2 with the carriage cover 52, can be provided. With the cartridge detection unit, the MFP 40 can detect a poor setting of the cartridge 2 in a case where the cartridge replacement mode ends when the cartridge 2 is not appropriately held.

When the poor setting of the cartridge 2 is detected, the MFP 40 can be configured to stop the carriage 3 in the cartridge replacement area F without allowing the carriage 3 to move. In addition, the MFP 40 can be configured to request a reconfirmation of setting of the cartridge 2 to an operator by displaying a message warning the poor setting of the cartridge 2.

Next, the description is made as to a head replacement mode.

When the head replacement mode is selected via an input unit such as a switch and a printer driver, and the access cover 74 is opened, the carriage 3 is moved to the head replacement area G and stops there. In this state, the recording head 1 can be replaced.

Figure 10:
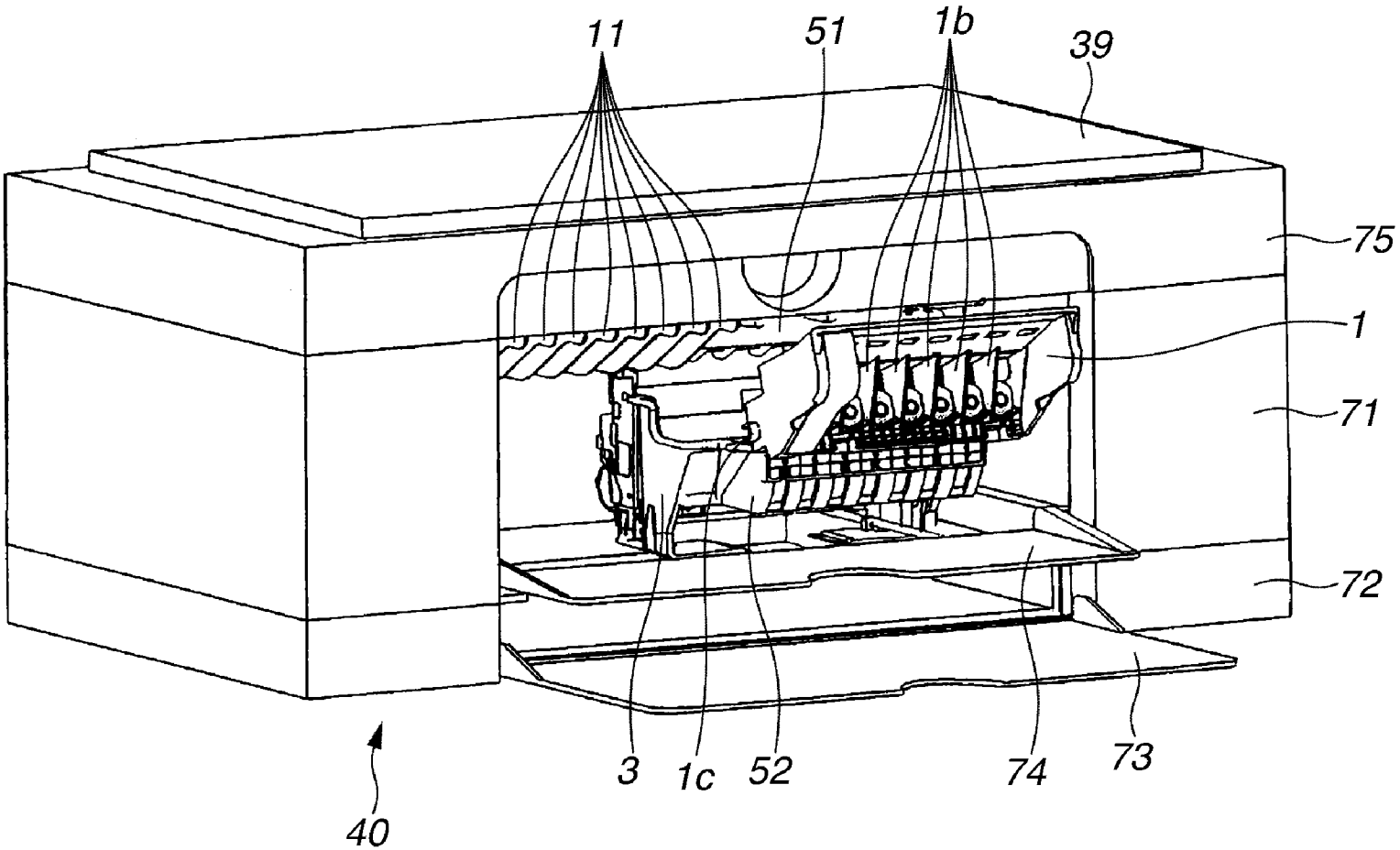
FIG. 10 is a perspective view that illustrates mounting of the head according to the first embodiment of the present invention.
Figure 11:
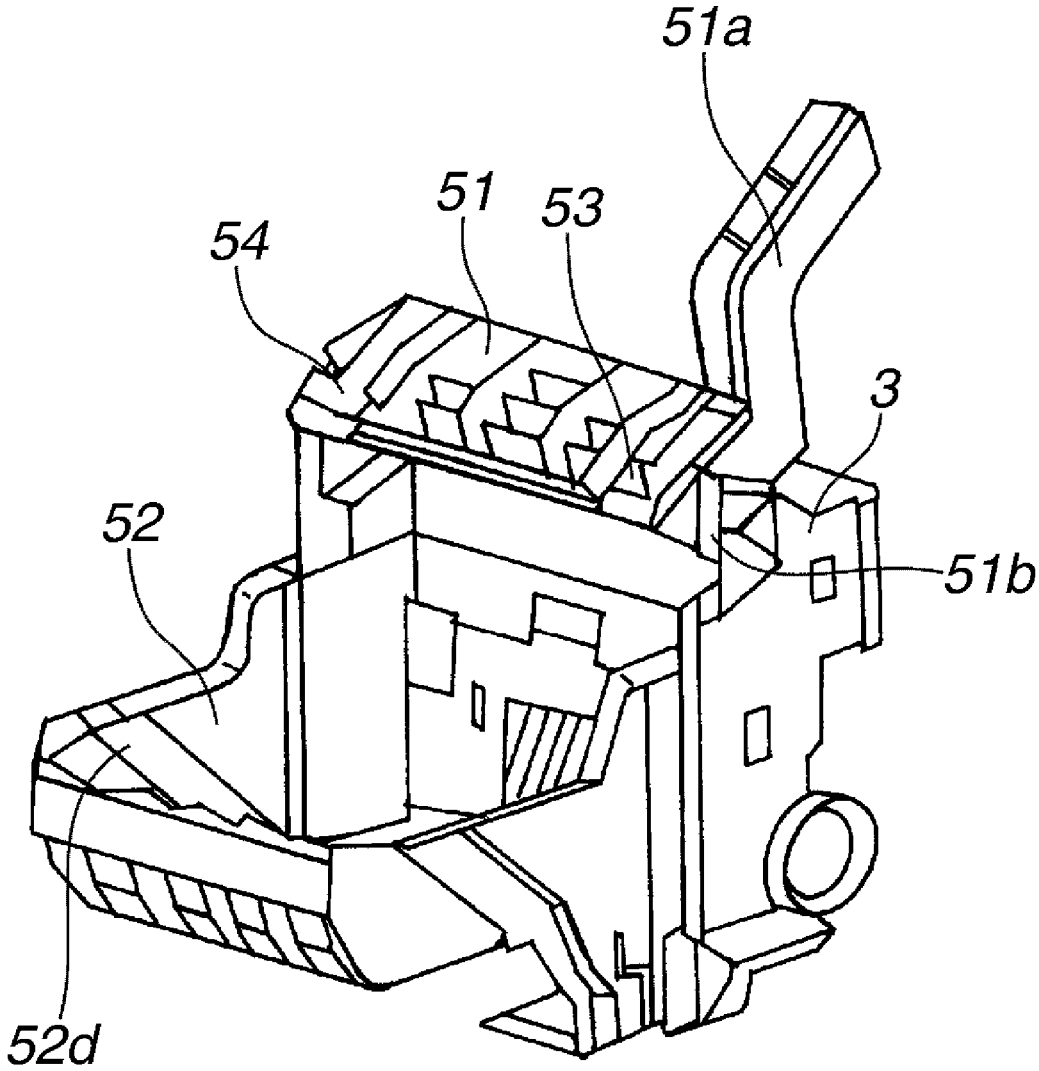
FIG. 11 is a perspective view of the carriage according to the first embodiment of the present invention.

FIGS. 10 through 13 are diagrams that respectively illustrate a method of fixing the recording head 1 to the carriage 3. As shown in FIG. 11, the carriage 3 includes a head fixing member 51 for pressing and fixing the recording head 1 to the carriage 3. The head fixing member 51 is mounted swinging around a shaft 51*b*. The head fixing member 51 can be abutted onto the recording head 1 by swinging the head fixing member 51 downward, and can be retracted from the top of the recording head 1 by swinging the head fixing member 51 upward. On one end in a direction of the shaft 51*b* of the head fixing member 51, a lever 51*a* is provided that functions as an operation unit that allows the operator to apply a force to swing the head fixing member 51. In the vicinity of both ends, in the direction of the shaft 51*b* of the head fixing member 51, first and second head pressing springs 53 and 54 are provided respectively. The head pressing springs 53 and 54 move around the shaft 51*b* when the head fixing member 51 is swung. The head pressing spring 53 and 54 generates a pressing force by closely contacting and fixing the recording head 1 to the carriage 3 when the head fixing member 51 is abutted onto the recording head 1.

As shown in FIG. 10, in the vicinity of a lower end of both sides of the recording head 1, a rough guide 1*c* is formed in a protruding manner. As shown in FIG. 11, the carriage cover 52 includes a groove 52*d* that corresponds to the rough guide 1*c*. The groove 52*d* extends downward in a slanting direction toward the back portion of the apparatus.

Figure 12:
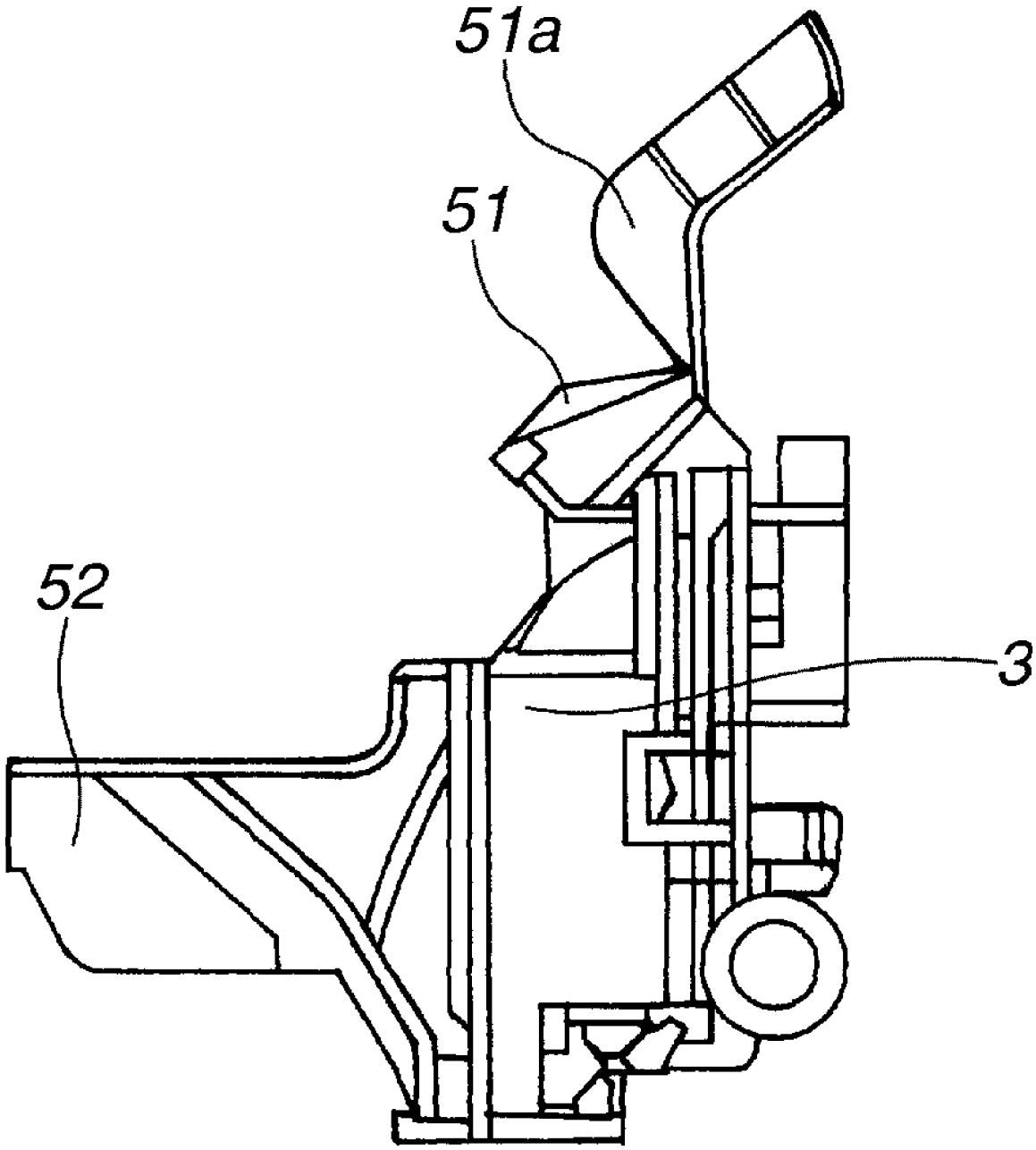
FIG. 12 is a cross section of a head fixing member according to the first embodiment of the present invention when the head fixing member is at a retracted position.
Figure 13:
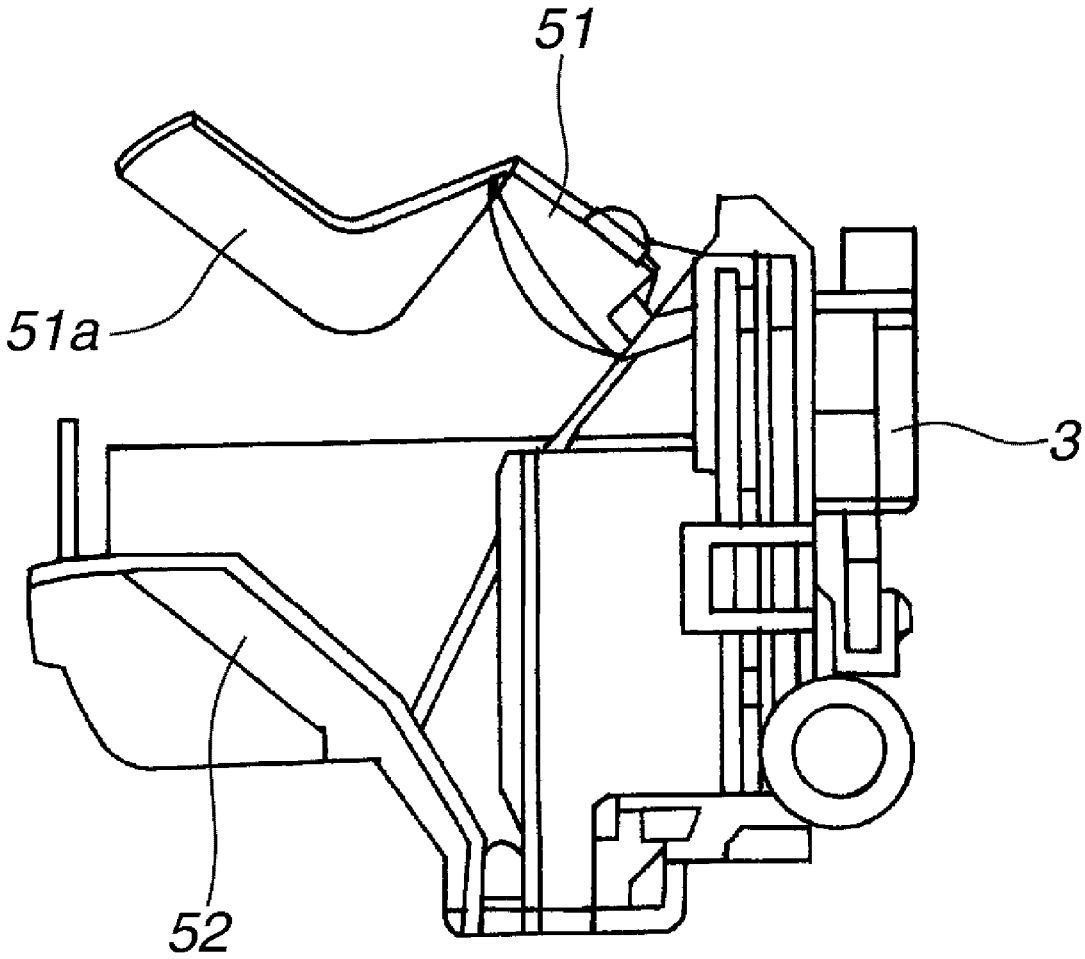
FIG. 13 is a cross section of a head fixing member according to the first embodiment of the present invention when the head fixing member is at a head holding position.

In mounting the recording head 1, first, the lever 51*a* is swung to retract the head fixing member 51 upward from a position at which the head fixing member 51 abuts onto an upper end of the recording head 1, as shown in FIG. 12. As shown in FIG. 10, the recording head 1 is inserted from the lower face toward the carriage 3 while inclining the top end of the head 1 to the front of the apparatus. Then, the rough guide 1*c* of the recording head 1 is guided along the groove 52*a* of the carriage cover 52. Thus, the recording head 1 can be readily inserted to a given fixing position preventing the recording head 1 from colliding with the carriage cover 52 or other components.

After the lower face of the recording head 1 is abutted onto the given position, the operator swings the lever 51*a* to abut the head fixing member 51 onto the upper end of the recording head 1. Thus, the recording head 1 is closely contacted and fixed to the carriage 3.

In disengaging the recording head 1, the operator swings the lever 51*a* to release the pressing, and then detaches the recording head 1 by drawing the top end of the recording head 1 to the front of the apparatus. The rough guide of the recording head 1 is guided along the groove 52*a* of the carriage cover 52, and accordingly, the recording head 1 can be readily detached while inclining the head to the front of the apparatus.

When the operation for replacing the recording head 1 ends and the access cover 74 is closed, the carriage 3 is moved to a given retraction position and is stopped there. Since the cartridge 2 is not yet installed, a message which urges the operator to install further the recording liquid storage cartridge 2, can be displayed by a display unit. When the operator opens the access cover 74 again, the apparatus recognizes that the cartridge replacement mode is selected. Then, the carriage 3 is moved to the cartridge replacement area F and stops there. The apparatus is now in a standby mode waiting for the installation of the cartridge 2.

When the cartridge 2 is installed, the cartridge 2 inhibits the attachment and detachment of the recording head 1. Therefore, when the head replacement mode is selected in a state where the cartridge is installed, a warning message can be displayed to the operator. Further, when the cartridge 2 is installed, a swing locking unit configured to inhibit the swing of the lever 51*a* of the carriage 3 can be provided. Thus, even when the replacement mode is selected in a state where the cartridge 2 is installed, a failure can be prevented which occurs when the operator attempts by mistake to release the recording head 1.

According to the first embodiment described above, by using the partitioning board 11 and the guiding board 12 provided in the cartridge replacement area F, the cartridge 2 can be readily replaced from the front of the apparatus. Further, by separately providing the head replacement area in addition to the cartridge replacement area F, the replacement of the recording head 1 can be performed from the front of the apparatus without being inhibited by the partitioning board 11 and the guiding board 12. In addition, with the rough guide 1*c* of the recording head 1 and the groove 52*d* of the carriage, the operation for replacing the recording head 1 from the front of the apparatus can be readily performed.

Accordingly, in this embodiment, in order to replace the recording head 1 and the cartridge 2, it is not necessary to configure the upper portion of the apparatus to be openable by retracting the scanner unit B. Since the scanner unit B needs not be retracted, the operability can be considerably improved.

Figure 14:
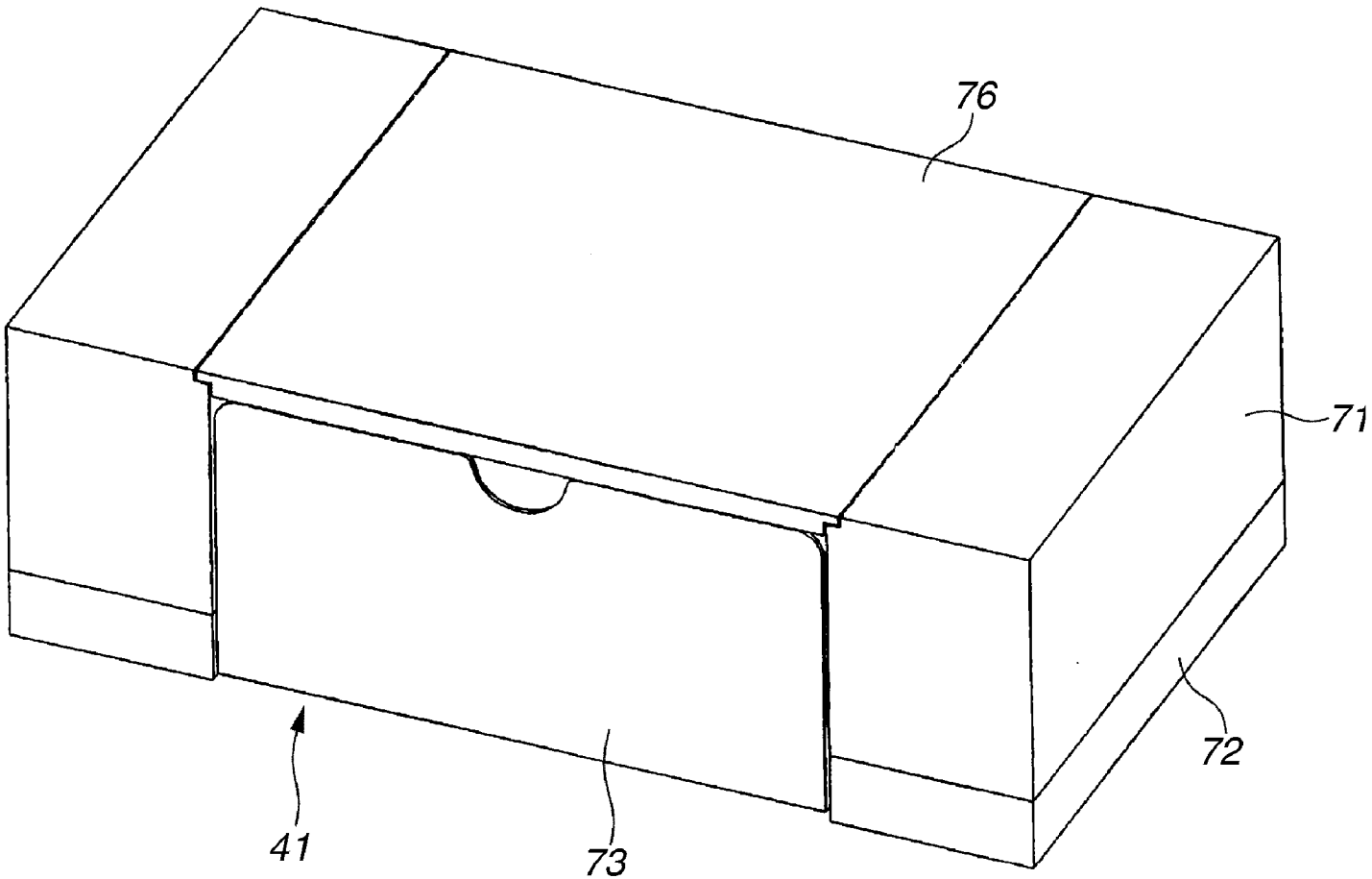
FIG. 14 is a perspective view of an SFP according to the first embodiment of the present invention.
Figure 15:
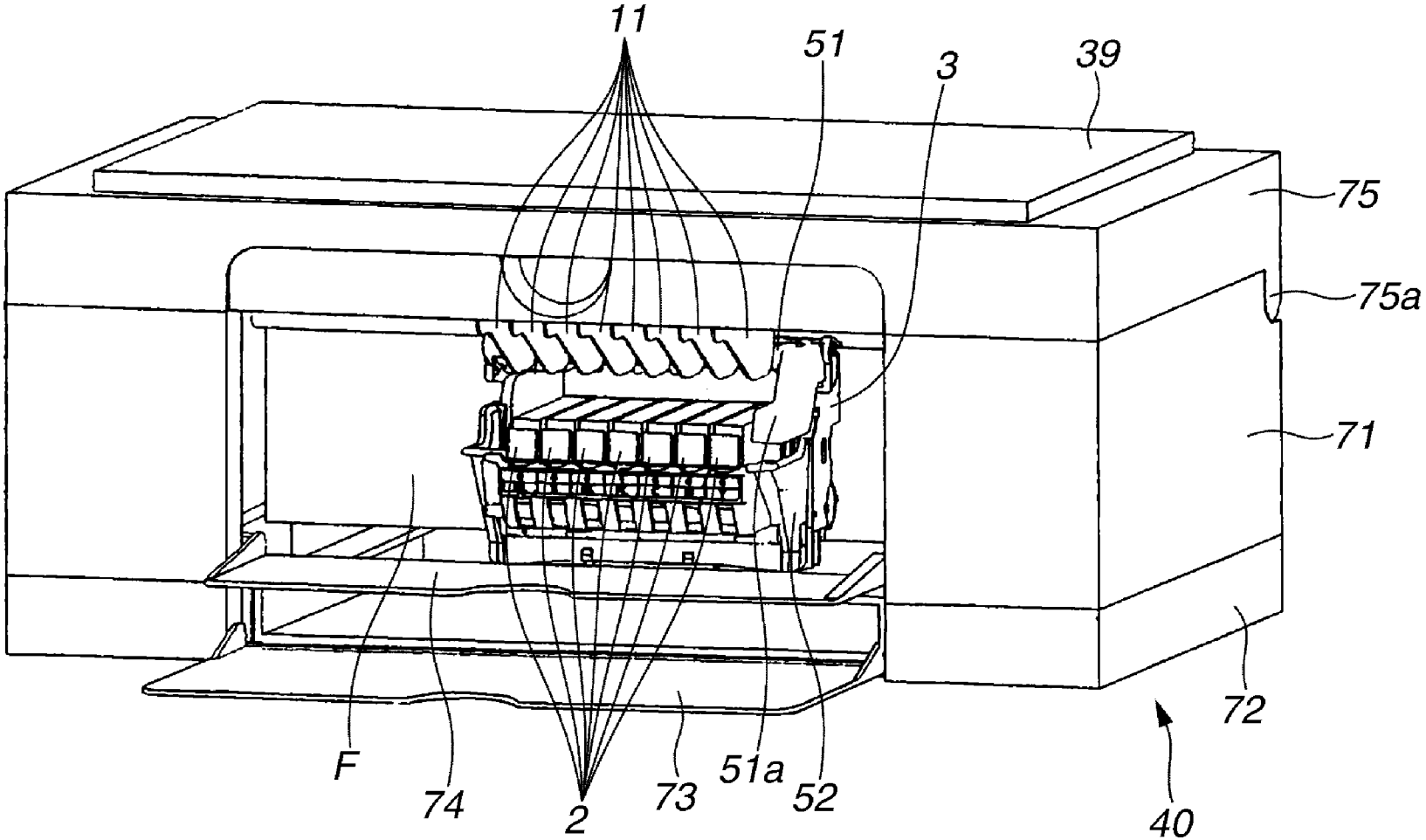
FIG. 15 is a perspective view that illustrates the MFP according to a second embodiment of the present invention in which a plurality of cartridges are mounted on the MFP.
Figure 16:
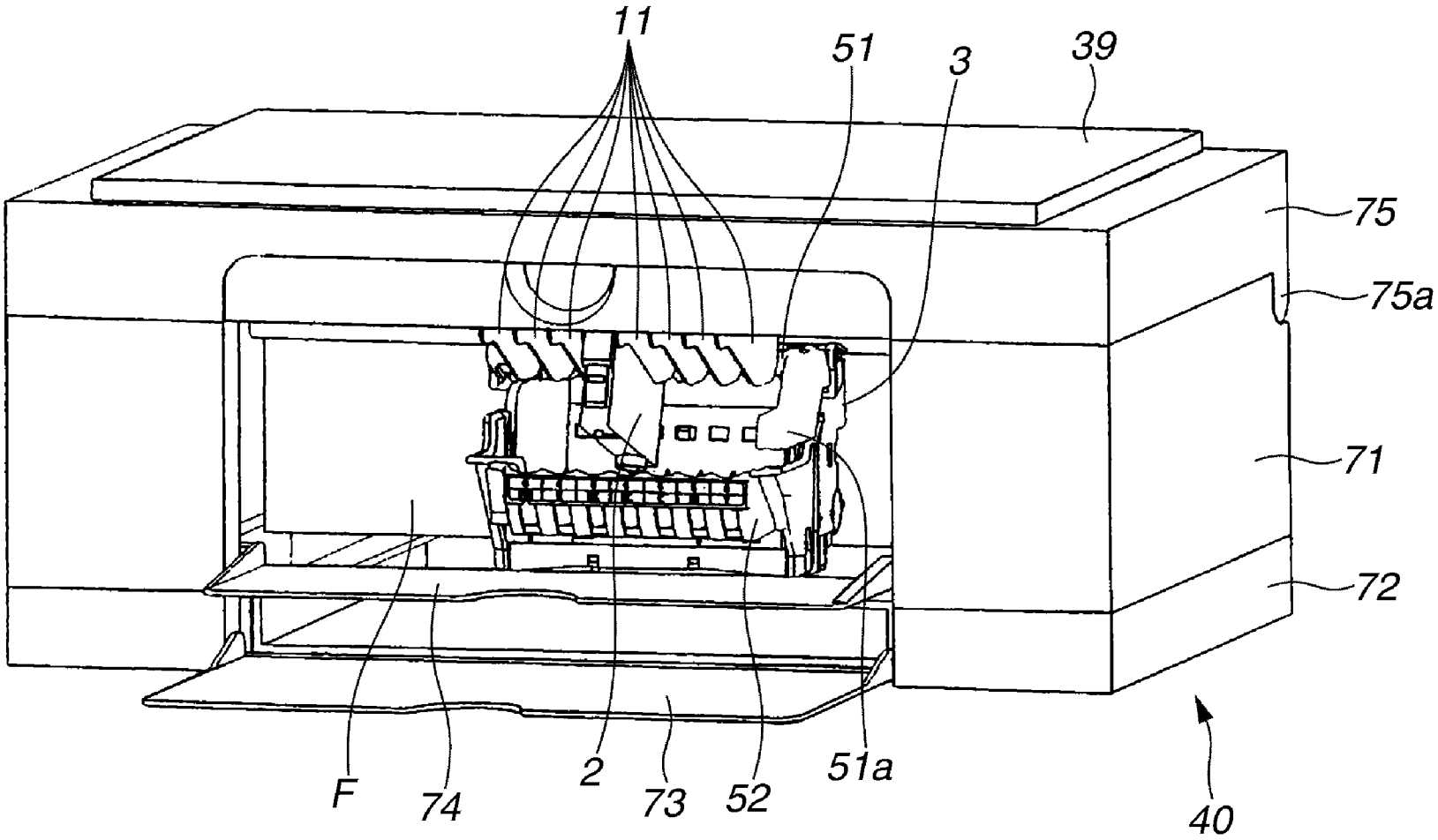
FIG. 16 is a perspective view that illustrates an operation of attaching and detaching the cartridge to and from the carriage according to the second embodiment of the present invention.

In the exemplary embodiment, the MFP 40 is described. However, the exemplary embodiment can also be applied to an SFP 41 as shown in FIG. 14. In the case of the SFP 41, the partitioning boards 11 and the guiding boards 12 can be formed on a lower face (not shown) of a ceiling unit outer cover 76. In the SFP, since the recording head 1 and the cartridge 2 can be replaced from the front of the apparatus, things and materials can be placed on the upper face of the apparatus including the ceiling unit outer cover 76, so that convenience of the apparatus can be improved. That is, the things and materials placed on the ceiling unit outer cover 76 need not be removed when the recording head 1 and the cartridge 2 are replaced. In the example as shown in FIG. 14, the ceiling unit outer cover 76 can be opened so that the conveyance unit is opened when a jammed paper is removed. However, instead of that configuration, the ceiling unit outer cover 76 can be a fixed one.

The configuration of this embodiment is especially effective when the joint portion 2*e* is formed on the bottom of the cartridge 2. Conventionally, in the apparatus of this type, the cartridge 2 can be replaced from a top of the apparatus. Instead, in the apparatus to which the configuration of this embodiment is applied, the replacement from the front side of the apparatus can be performed. Accordingly, an advantageous effect as described above can be obtained. The configuration of this embodiment is also effective in the apparatus in which a joint portion of a cartridge is disposed on a side or an upper face. By applying the configuration of the exemplary embodiment to the apparatus of this type, the operability in replacing the cartridge can be improved.

In the MFP 40 and the SFP 41, the direction in which the head discharges the recording liquid, is set in the direction of the bottom of the apparatus. However, the present embodiment can also be applied to the apparatus in which the direction of discharging the recording liquid is set toward the side of the apparatus or toward the upper face of the apparatus.

Second Embodiment

Now, the MFP is described according to a second embodiment of the present invention with reference to FIGS. 15 through 18. The components that are the same as those in the first embodiment are denoted with the same numerals and symbols, and thus the description of the same components is omitted here.

In the second embodiment, the area that is opened by the access cover 74 is set in the cartridge replacement area F. That is, in the cartridge replacement area F, the partitioning boards 11 and the guiding boards 12 (see FIG. 17 and FIG. 18) are formed on the lower face 75*a* of the scanner housing 75 in a protruding manner.

Figure 17:
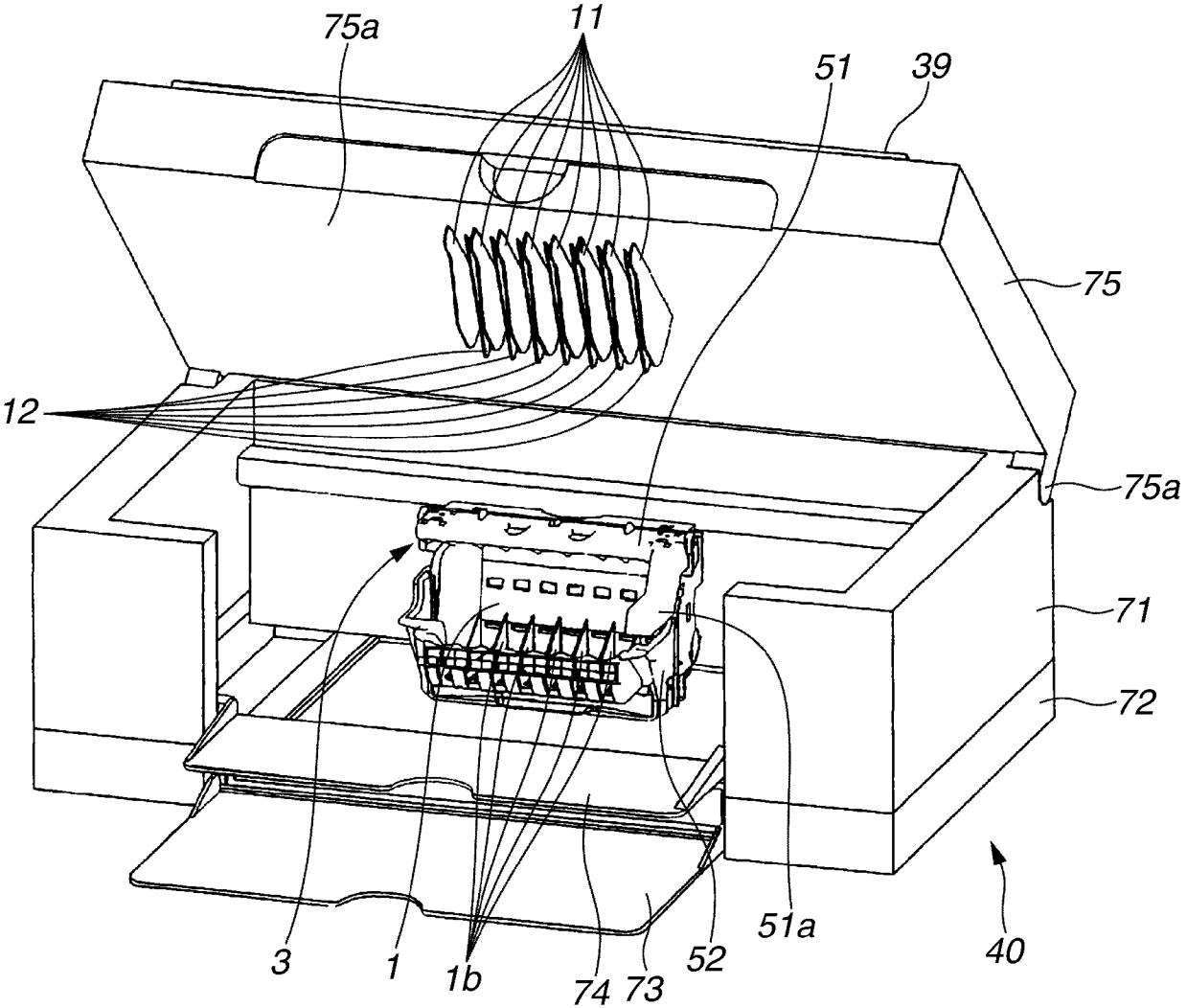
FIG. 17 is a perspective view that illustrates a state where a scanner housing is opened according to the second embodiment of the present invention.
Figure 18:
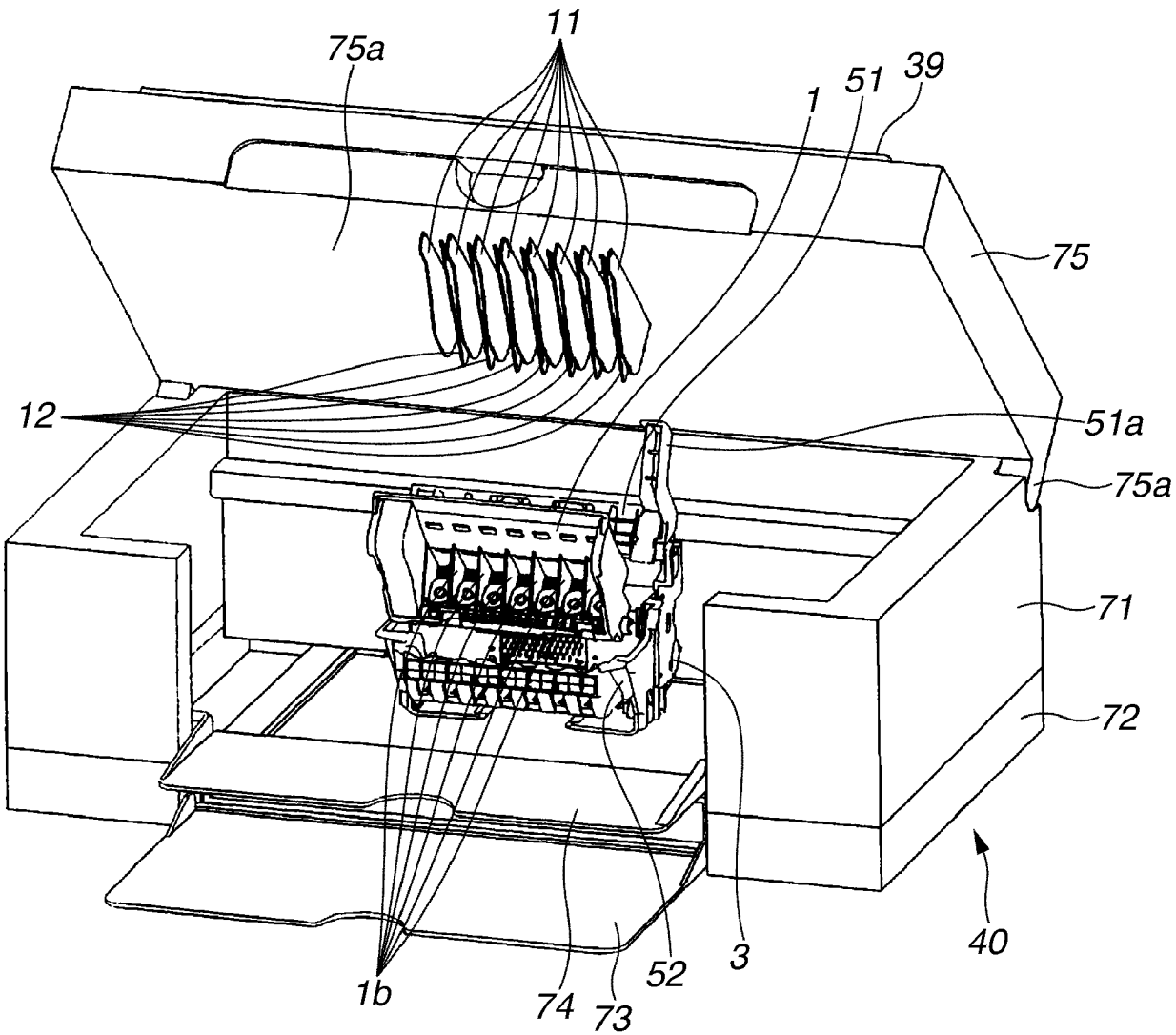
FIG. 18 is a perspective view that illustrates a state before the head is mounted and fixed according to the second embodiment of the present invention.

The scanner unit B (the scanner housing 75) is mounted in a swinging manner, as shown in FIG. 17 and FIG. 18. The scanner unit B can be opened upward to expose the upper portion of the recording unit A to the outside, by a hinge unit 75*a* provided in the back portion of the apparatus. The partitioning boards 11 and the guiding boards 12 are integrally formed on the lower face 75*a* of the scanner housing 75. When the carriage cover 52 is swung and opened, the scanner unit B is separated and retracted from the recording unit A. According to the present embodiment, the liquid discharge recording head 1 can be replaced in this manner.

In the second embodiment, when the access cover 74 is opened to the front side of the apparatus in a normal state in which no paper jamming occurs, the cartridge replacement mode is selected. When the cartridge replacement mode is selected, the carriage 3 moves to the cartridge replacement mode F. The carriage 3 stops at a position where the partitioning boards 11, and the partitioning members 1*b* and 52*c* of the recording head 1 and the carriage cover 52, oppose each other (see FIG. 15). The partitioning boards 11 are formed on the lower surface 75*a* of the scanner housing 75 in a protruding manner In this state, the engagement of the latch lever 2*d* of the cartridge 2 that is to be replaced, is released. Then the recording liquid storage cartridge 2 is lifted upward so as to be detached from the front of the apparatus. The cartridge 2 can be easily detached from the carriage cover 52 being guided by the guiding board 12. After that, a new cartridge 2 is inserted from an insertion slot in the front portion of the apparatus. The insertion slot is surrounded and defined by the partitioning boards 11, the lower face 75*a* of the scanner housing 75, and the end of the carriage cover 52. The cartridge 2 is guided to a given fixing position by the guiding board 12 (see FIG. 16) so as to be engaged in position.

Then, the scanner housing 75 swings upward to open the housing. At the same time, the access cover 74 is swung to the front to open the apparatus, and the head replacement mode is selected. In a case of dismounting the recording head 1, the cartridge 2 needs to be previously dismounted. In the configuration of this embodiment, when the upper portion of the apparatus is opened, the partitioning boards 11 and the guiding board 12 are also separated from the cartridge replacement area F. However, in this state, the cartridge 2 can be dismounted just as in the case of the conventional technique (see FIG. 23).

In either case, the recording head 1 is replaced in a state where all the cartridges 2 are dismounted, as shown in FIG. 17. After the lever 51*a* is swung upward to release the pressed state of the recording head 1, the recording head 1 can be easily detached from the front of the apparatus or upward by inclining the top end of the recording head 1 to the front of the apparatus.

In inserting the recording head 1, the operator swings the lever 51*a* of the carriage 3 so as to previously retract the head fixing member 51. The recording head 1 is inserted into the carriage 3 from the front of the apparatus or from the top of the apparatus, with the lower face of the head 1 at the head, in a state where the upper end of the recording head 1 is inclined to the front of the apparatus. The rough guide 1*c* of the recording head 1 is guided by the groove 52*a* of the carriage cover 52, and abuts to a given position. Finally, the lever 51*a* is swung downward, and the recording head 1 is held in the carriage 3 in a pressed state.

After the recording head 1 is mounted, when the scanner housing 75 is closed in a state where the access cover 74 is opened, the partitioning boards 11 and the guiding boards 12 enter the cartridge replacement area F again. Thus, the cartridge 2 can be mounted from the front of the apparatus. The cartridge 2 can also be mounted from the top of the apparatus while the scanner housing 75 is kept open.

With the above configuration, the cartridge 2, which is frequently replaced, can be replaced from the front of the apparatus. A space and area for swinging and opening the scanner housing 75 does not need to be secured in installing the MFP 40. Once the recording head 1 is mounted on the carriage, the recording head 1 rarely needs to be replaced thereafter unless a failure of the device occurs. The scanner housing 75, whose weight increases as the scanner unit B is installed therein, is rarely swung again, and the operability of the apparatus is considerably improved.

The access for attaching and detaching the cartridge 2 is not limited to that from the front of the apparatus. The access from the top of the apparatus can also be obtained by swinging the scanner housing 75, as the circumstances demand.

Figure 19:
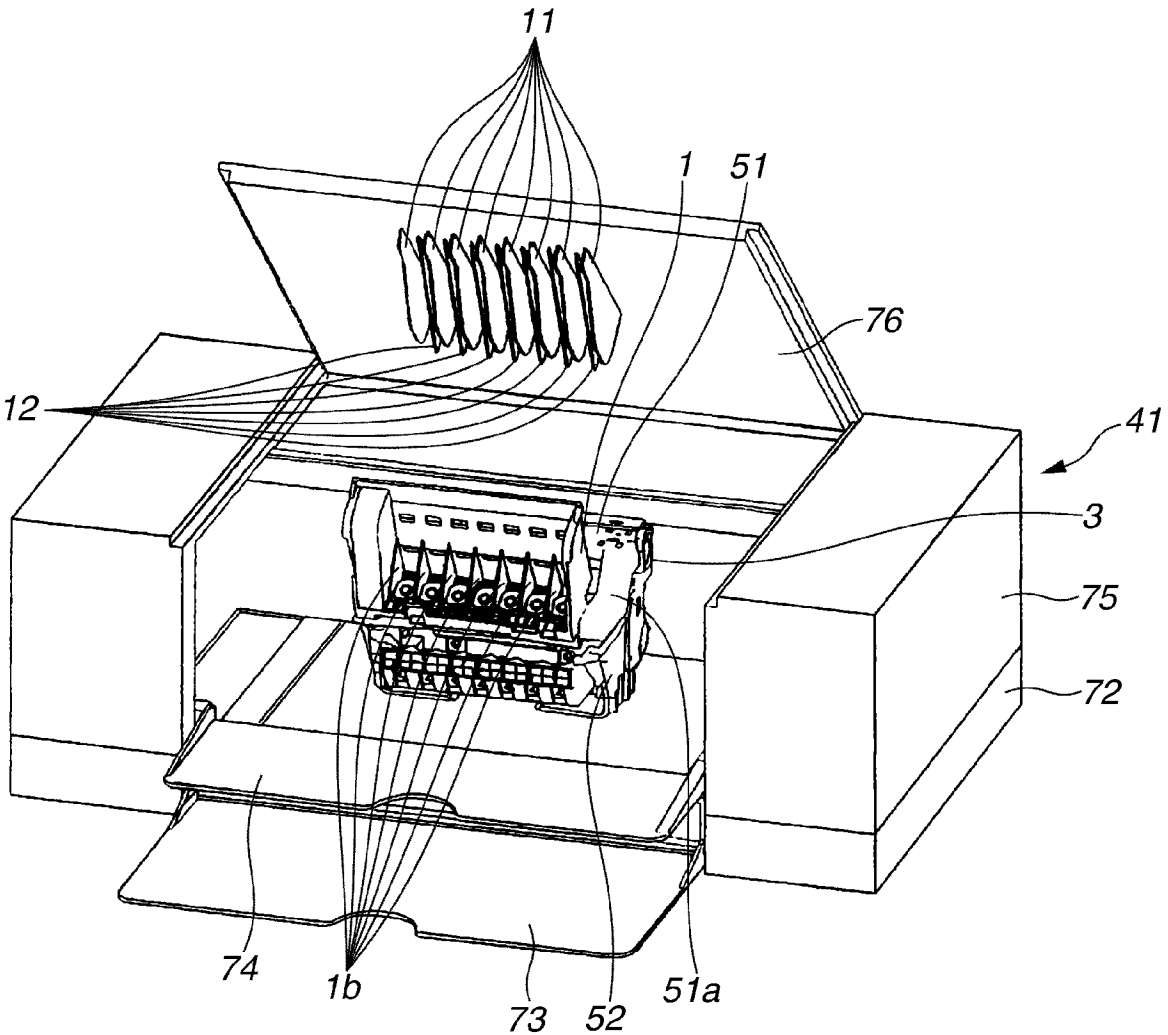
FIG. 19 is a perspective view that illustrates a state after the head is mounted and fixed according to the second embodiment of the present invention.

The scanner unit of the MFP 40 can be opened and closed in the manner as described above according to the second embodiment of the present invention. The above configuration can also be applied to the SFP 41, as shown in FIG. 19. In this case, the partitioning boards 11 and the guiding boards 12 are integrally formed on the lower face of the ceiling unit outer cover 76. The outer cover 76 can be opened and closed swinging around the edge of the apparatus at the back of the apparatus. In this configuration, when the recording head 1 is attached and detached, the ceiling unit outer cover 76 is opened by swinging, and the access is obtained from the top of the apparatus. On the other hand, when the cartridge is attached and detached, the paper discharge cover 73 is opened by swinging, and the access can be obtained from the front of the apparatus. Thus, owing to the effect of the partitioning boards 11 and the guiding boards 12, the operation for replacement can be readily performed from the front of the apparatus. With this configuration, materials and things can be placed on the horizontal upper surface of SEP 41 so that the convenience of the apparatus is improved. In addition, the things and materials placed on the SFP 41 need not be displaced when the cartridge 2 is replaced.

Third Embodiment

Figure 20:
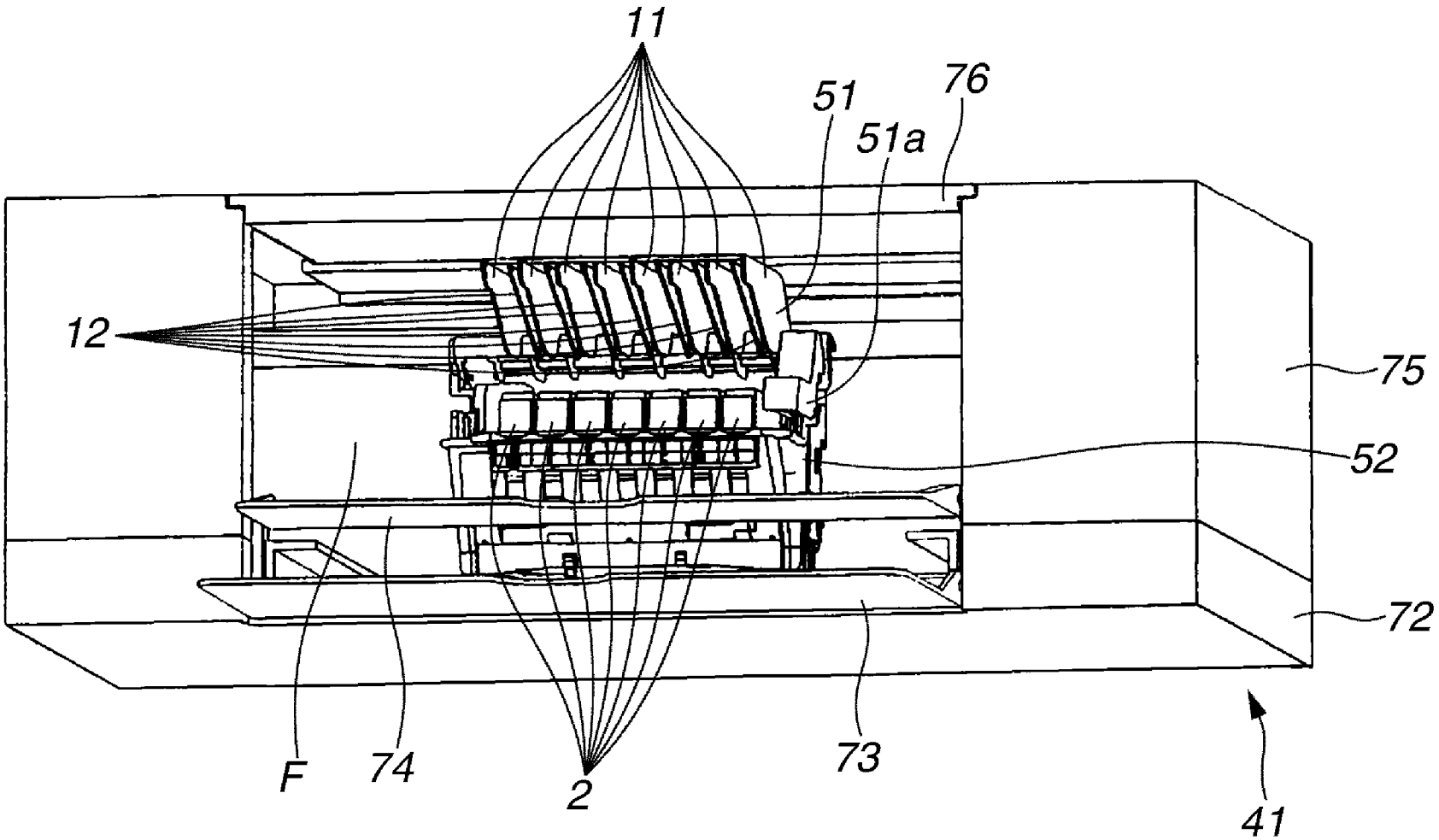
FIG. 20 is a perspective view that illustrates a head fixing member, guiding members, and partitioning members according to a third embodiment of the present invention.
Figure 21:
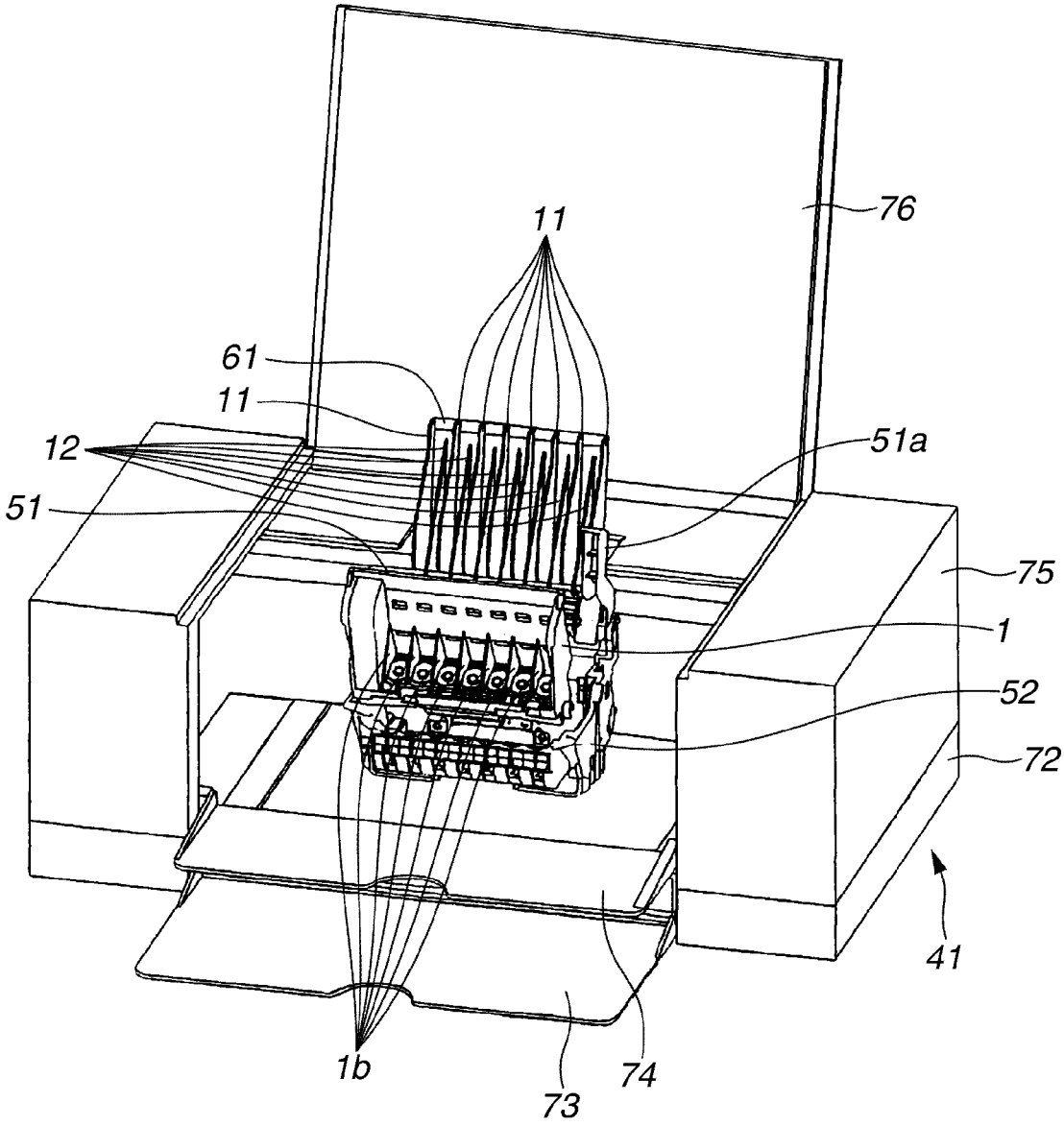
FIG. 21 is a perspective view that illustrates a state where the head fixing member is opened.
Figure 22:
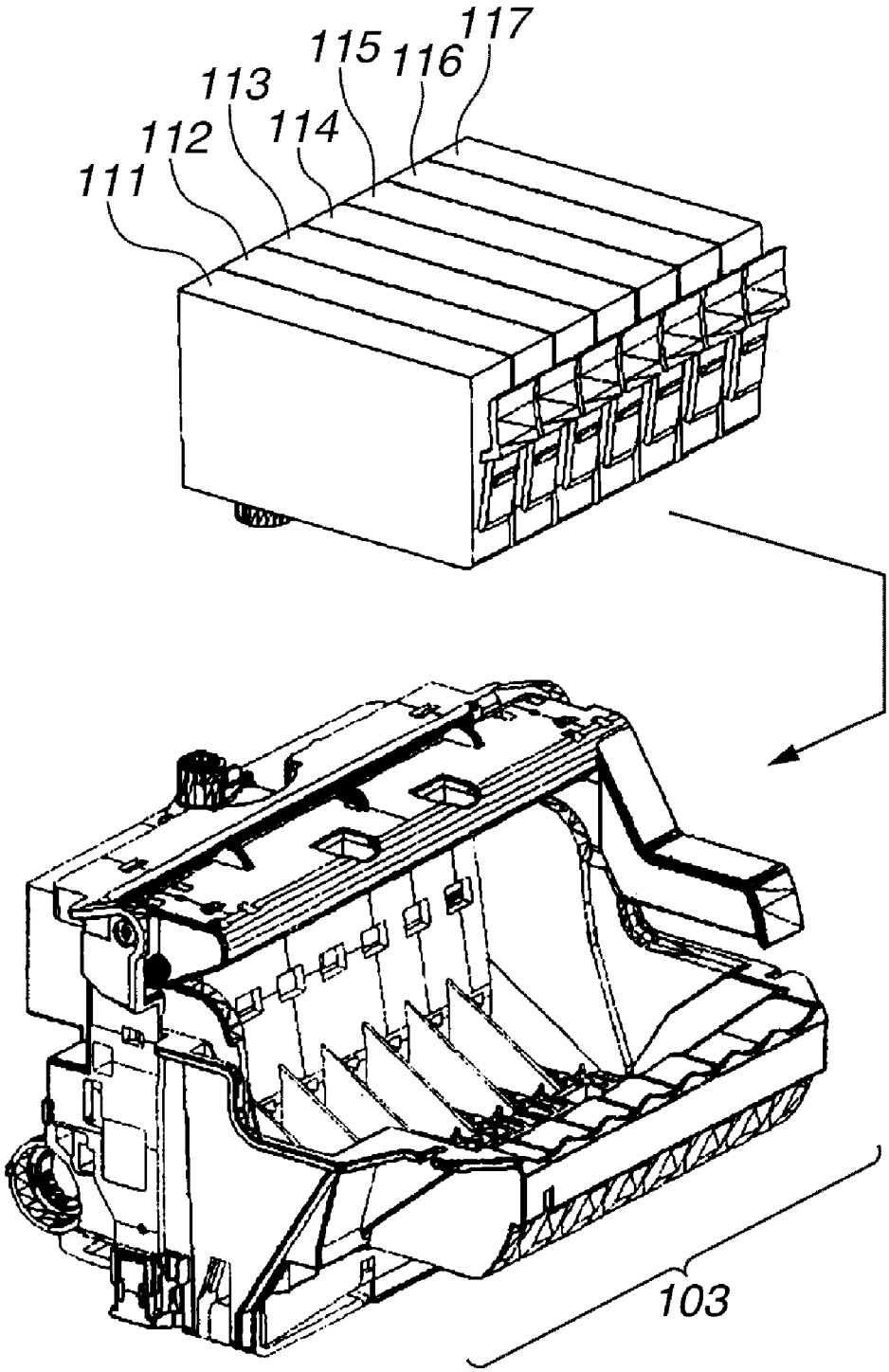
FIG.22 (PRIOR ART)
FIG. 22 is a perspective view that illustrates the carriage, the head, and the cartridges according to a conventional example.
Figure 23A:
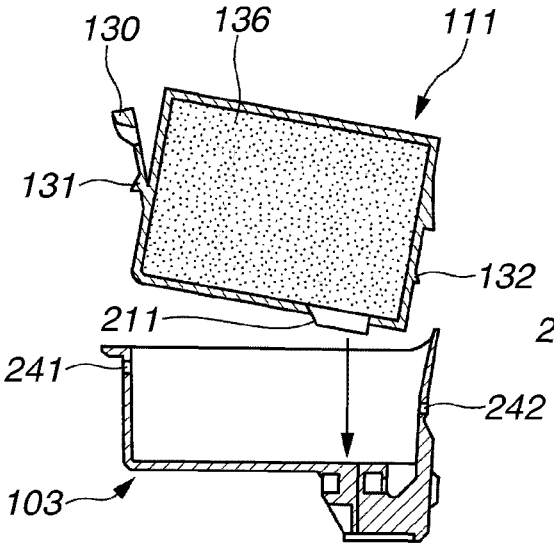
FIG.23A (PRIOR ART)
FIG. 23A is a cross section showing a state of the cartridge and the carriage before the cartridge is mounted according to the conventional example.
Figure 23B:
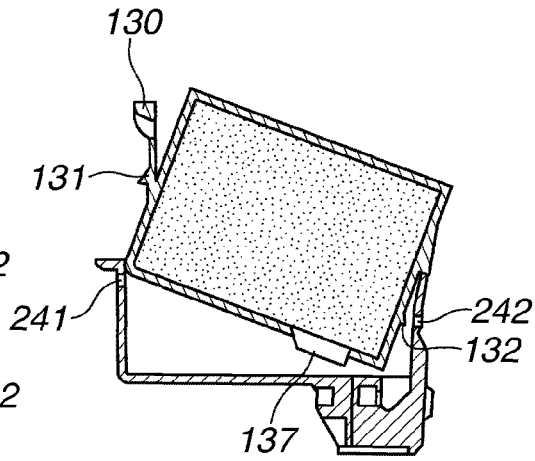
FIG.23B (PRIOR ART)
FIG. 23B is a cross section showing a state where the mounting of the cartridge on the holder is started according to the conventional example.
Figure 23C:
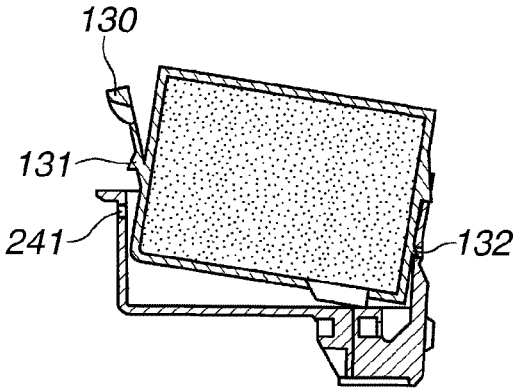
FIG.23C (PRIOR ART)
FIG. 23C is a cross section showing a state where the mounting of the cartridge is being performed according to the conventional example.
Figure 23D:
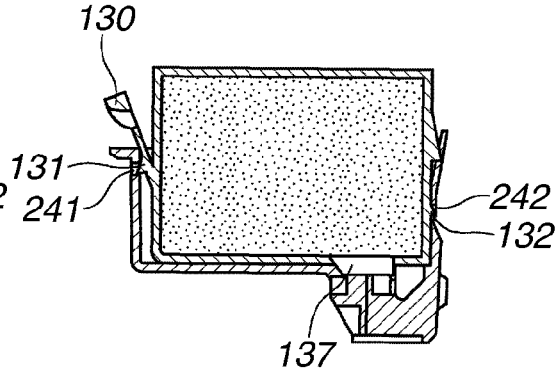
FIG.23D (PRIOR ART)
FIG. 23D is a cross section showing a state where the mounting of the cartridge is completed according to the conventional example.

Now, a third embodiment of the present invention is described with reference to FIG. 20 and FIG. 21. FIG. 20 and FIG. 21 are external perspective views of the SFP 41 according to the third embodiment. In FIG. 20 and FIG. 21, the components that are the same as those in the first embodiment and the second embodiment are denoted by the same numerals and symbols, and thus the description of the same components is omitted here.

In the SFP 41 of the third embodiment, a plurality of the partitioning boards 11 and the guiding boards 12 are arranged in a direction of the shaft 51*b* of the head fixing member 51 that is provided in the carriage or a holder. The partitioning boards 11 and the guiding boards 12 are integrally formed protruding downward from a top board 61. The partitioning boards 11 and the guiding boards 12, when the recording head 1 is pressed to be held by the head fixing member 51, are disposed where the cartridge 2 can be guided in attaching and detaching to and from the front of the apparatus. The partitioning boards 11 are positioned above the partitioning members 1*b* and 52*c* of the recording head 1 and the carriage cover 52 opposing the partitioning members 1*b* and 52*c*. The partitioning board 11 and the guiding board 12 can be separated from the cartridge 2 and the recording head 1 by swinging the head fixing member 51 upward from the position at which the recording head 1 is pressed (that is, to a retraction position). In this state, the recording head 1 can be easily replaced without receiving inhibition from the partitioning boards 11 and the guiding boards 12.

In the SFP 41 according to the third embodiment, when the access cover 74 is opened to the front of the apparatus in a normal state in which no paper jamming occurs, the cartridge replacement mode is selected. When the cartridge replacement mode is selected, the carriage 3 moves to the cartridge replacement mode F, whose front portion is exposed to the outside by opening the access cover 74, and stops there (see FIG. 20).

In this state, the engagement of the latch lever 2*d* of the cartridge 2 that is to be replaced, is released, and then the cartridge 2 is lifted upward to be taken out to the front of the apparatus. The cartridge 2 can be easily taken out of the carriage cover 52 being guided by the guiding board 12. In mounting a new cartridge 2, the cartridge 2 is inserted from an insertion slot in the front portion of the apparatus. The insertion slot is surrounded and defined by the partitioning boards 11, a top board 61, and the end 52*a* of the carriage cover 52. The cartridge 2 is guided to a given fixing position by the guiding board 12 to be engaged in position.

On the other hand, when the ceiling unit outer cover 76 is swung upward to be opened and the access cover 74 is swung to the front to be opened, the head replacement mode is selected.

In dismounting the recording head 1, the cartridge 2 needs to be previously dismounted. In dismounting the cartridge 2, the operation for dismounting can be performed from the front of the apparatus in the same manner as the cartridge replacement mode in the state where the recording head 1 is pressed as it is. Or otherwise, the cartridge 2 can be dismounted from the top of the apparatus by swinging and retracting the head fixing member 51.

In either case, the replacement of the recording head 1 is started when the head fixing member 51 is swung upward and retracted by swinging the lever 61*a* of the carriage 3. As shown in FIG. 21, the recording head 1 can be easily taken out of the apparatus to the front or top of the apparatus by inclining the top end of the recording head 1 to the front of the apparatus. In installing the recording head 1, the recording head 1 is inserted into the carriage 3 from the front or top of the apparatus while the top end of the recording head 1 is inclined to the front of the apparatus with the lower face of the recording head 1 at the head. The rough guide 1*c* of the recording head 1 is guided by the groove 52*a* of the carriage cover 52, and thus the recording head 1 abuts to a given position. Finally, the lever 51*a* is swung, and the recording head 1 is pressed to be held in the carriage 3. Since the partitioning boards 11 and the guiding board 12 are entered into a portion above the recording head 1, the cartridge 2 can be easily replaced from the top of the apparatus.

With the above configuration, the access for replacing the cartridge 2, which is frequently replaced, can be obtained from the front of the apparatus, and the access from the top of the apparatus is necessary only in replacing the recording head 1, which is rarely replaced. Since the things and materials placed on the SFP 41 need not be displaced in replacing the cartridge 2, the convenience of the apparatus can be improved.

The configuration of the SFP according to the third embodiment of the present invention is as described above. However, this embodiment can also be applied to the MFP. In this case, the scanner unit is of a open/close type. When the recording head 1 is replaced, the scanner unit is opened and a head fixing member of the carriage is swung and retracted. In the configuration of this type, the frequency of opening and closing the scanner unit is considerably reduced, and accordingly, the operability of the apparatus can be highly improved.

In addition, the space necessary for swinging the scanner housing needs not be secured in installing the MFP.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2005-338515 filed Nov. 24, 2005, which is hereby incorporated by reference herein in its entirety.

What is claimed is:

1. A liquid jet recording apparatus comprising:

an upper face and an inner wall surface opposing the upper face;

a recording head configured to record with droplets;

a carriage supporting the recording head and configured to scan a recording medium with the recording head in a direction crossing a direction of conveyance of the recording medium, the carriage being movable to a maintenance position;

a holder provided in one of the recording head and the carriage;

a recording liquid cartridge adapted to contain liquid for recording, the recording liquid cartridge being attachable to and detachable from the holder at the maintenance position; and a guiding unit adapted to guide at least two different sides of the recording liquid cartridge, with respect to the carriage at the maintenance position, to the inner wall surface, wherein the guiding unit includes:

a guiding portion that guides the cartridge toward a direction of insertion into a mounting position of the holder; and a partitioning portion that restricts a position of the carriage in a scanning direction at a time of insertion of the cartridge.

2. A liquid jet recording apparatus comprising:

an upper face and an inner wall surface opposing the upper face;

a recording head configured to record with droplets;

a carriage supporting the recording head and configured to scan a recording medium with the recording head in a direction crossing a direction of conveyance of the recording medium, the carriage being movable to a maintenance position;

a holder provided in one of the recording head and the carriage;

a recording liquid cartridge adapted to contain liquid for recording, the recording liquid cartridge being attachable to and detachable from the holder at the maintenance position; and a guiding unit adapted to guide at least two different sides of the recording liquid cartridge, with respect to the carriage at the maintenance position, to the inner wall surface, wherein the maintenance position includes a first maintenance position at which the recording liquid cartridge is replaced and a second maintenance position at which the head is replaced, and wherein the guiding unit is provided on the inner wall surface that opposes an upper surface of the carriage that stops at the first maintenance position.

3. A liquid jet recording apparatus comprising:

an upper face and an inner wall surface opposing the upper face;

a recording head configured to record with droplets;

a carriage supporting the recording head and configured to scan a recording medium with the recording head in a direction crossing a direction of conveyance of the recording medium, the carriage being movable to a maintenance position;

a holder provided in one of the recording head and the carriage;

a recording liquid cartridge adapted to contain liquid for recording, the recording liquid cartridge being attachable to and detachable from the holder at the maintenance position;

a guiding unit adapted to guide at least two different sides of the recording liquid cartridge, with respect to the carriage at the maintenance position, to the inner wall surface r; and a scanner unit configured to read an image, wherein the inner wall surface includes a wall surface of the scanner unit.

* * * * *